US008490939B2

(12) United States Patent
Pasto

(10) Patent No.: US 8,490,939 B2
(45) **Date of Patent: *Jul. 23, 2013**

(54) METHOD AND APPARATUS FOR BUTTRESS STABILIZATION AND INTEGRATED ILLUMINATION MEANS

(75) Inventor: Cris E. Pasto, Spencer, NY (US)

(73) Assignee: Res-Q-Jack, Inc., Elmira, NY (US)

( * ) Notice: Subject to any disclaimer, the term of this patent is extended or adjusted under 35 U.S.C. 154(b) by 1206 days.

This patent is subject to a terminal disclaimer.

(21) Appl. No.: 11/115,782

(22) Filed: Apr. 27, 2005

(65) Prior Publication Data

US 2005/0247850 A1 Nov. 10, 2005

Related U.S. Application Data

(63) Continuation-in-part of application No. 10/720,997, filed on Nov. 24, 2003, now Pat. No. 7,338,025, which is a continuation-in-part of application No. 09/982,368, filed on Oct. 18, 2001, now Pat. No. 6,772,984.

(60) Provisional application No. 60/565,619, filed on Apr. 27, 2004.

(51) Int. Cl.
*A47F 5/00* (2006.01)

(52) U.S. Cl.
USPC ..... 248/354.5; 248/352; 254/45

(58) Field of Classification Search
USPC ..... 248/676; 362/84, 145, 152, 267; 269/901, 269/55, 17; 254/2 B, 2 C, DIG. 15
See application file for complete search history.

(56) References Cited

U.S. PATENT DOCUMENTS

| | | | | | |
|---|---|---|---|---|---|
| 2,219,903 | A | | 10/1940 | Pfauser | |
| 2,630,296 | A | | 3/1953 | Lucker | |
| 2,684,824 | A | | 7/1954 | Hillberg | |
| 2,696,359 | A | | 12/1954 | Hill | |
| 2,772,347 | A | * | 11/1956 | Lanmon | 362/145 |
| 2,825,796 | A | * | 3/1958 | Lammon | 362/152 |
| 3,430,911 | A | | 3/1969 | Olson | 248/354 |
| 4,057,994 | A | | 11/1977 | Wolgast et al. | 72/441 |
| 4,198,847 | A | | 4/1980 | Russell et al. | |
| 4,872,230 | A | * | 10/1989 | Levine | 7/100 |
| 5,056,753 | A | | 10/1991 | Lunau et al. | |
| 5,322,315 | A | | 6/1994 | Carsten | 280/479.2 |
| 5,520,030 | A | | 5/1996 | Muldoon | |
| 5,690,348 | A | | 11/1997 | Williams, Jr. | 280/477 |
| 5,788,204 | A | | 8/1998 | Goodwin et al. | 248/357 |
| 5,797,226 | A | | 8/1998 | MacKarvich | |
| 6,017,170 | A | | 1/2000 | Michalo | 405/272 |
| 6,158,705 | A | | 12/2000 | Cudmore et al. | 248/354.1 |
| 6,234,440 | B1 | | 5/2001 | Boney et al. | |
| 6,357,724 | B1 | | 3/2002 | Hung | 254/8 B |
| 6,530,675 | B1 | * | 3/2003 | Van Etten | 362/267 |
| 6,637,908 | B1 | * | 10/2003 | Hung | 362/109 |
| 6,695,289 | B1 | | 2/2004 | Mickael | 254/122 |

(Continued)

*Primary Examiner* — Gwendolyn Baxter
(74) *Attorney, Agent, or Firm* — Aquilla Patents & Marks PLLC; Thomas T. Aquilla

(57) ABSTRACT

A method for stabilizing a vehicle in an unstable condition includes the steps of placing one or more beam-like structures at the floor pan or vehicle undercarriage of a damaged vehicle resting on its roof, side, or in an upright or other position, aligning the beam-like structure substantially parallel with the length of the vehicle, and securing the beam-like structure to the vehicle at one or more points, using hooks, straps, chains, or a similar securing mechanism.

11 Claims, 24 Drawing Sheets

U.S. PATENT DOCUMENTS

| | | | | |
|---|---|---|---|---|
| 6,776,383 | B2 | 8/2004 | Lanka | 248/352 |
| 6,910,677 | B1 * | 6/2005 | Miller et al. | 254/126 |
| 2003/0043581 | A1 | 3/2003 | Finnigan | 362/253 |
| 2003/0177645 | A1 | 9/2003 | Flurry et al. | 30/392 |
| 2003/0231487 | A1 * | 12/2003 | Chien | 362/84 |
| 2005/0263670 | A1 * | 12/2005 | Pasto | 248/676 |
| 2007/0279899 | A1 * | 12/2007 | Sheridan | 362/152 |

* cited by examiner

27a

27b

METHOD AND APPARATUS FOR BUTTRESS STABILIZATION AND INTEGRATED ILLUMINATION MEANS

REFERENCE TO RELATED APPLICATIONS

This is a continuation-in-part patent application of application Ser. No. 10/720,997, filed Nov. 24, 2003, entitled "METHOD AND APPARATUS FOR BUTTRESS STABILIZATION", which is a continuation-in-part patent application of Ser. No. 09/982,368, filed Oct. 18, 2001, entitled "METHOD AND APPARATUS FOR BUTTRESS STABILIZATION", now issued as U.S. Pat. No. 6,772,984. The aforementioned applications are hereby incorporated herein by reference in their entireties. This application claims an invention, which was disclosed in Provisional Application No. 60/565,619, filed Apr. 27, 2004, entitled "IMPROVED RESCUE TOOLS". The benefit under 35 USC §119(e) of the United States provisional application is hereby claimed, and the aforementioned provisional application is hereby incorporated herein by reference in its entirety.

BACKGROUND OF THE INVENTION

1. Field of the Invention

The invention pertains to the field of emergency rescue. More particularly, the invention pertains to methods and apparatus for stabilizing a roof-resting motor vehicle, such as for access by rescue workers, and for extracting accident victims from the vehicles.

2. Description of Related Art

A roof-resting motor vehicle can be a difficult situation for rescue teams, particularly in terms of vehicle stabilization. In any vehicle stabilization effort, quick and simple solutions are desired; time spent on vehicle stabilization is time not spent on victim extrication and patient care. However, what often is overlooked is that most of the known quick and simple techniques for stabilizing a roof-resting vehicle interfere with access to the passenger compartment. Many of these techniques include the step of attaching restraint straps to the rear posts of the vehicle, or running straps across the door up to the undercarriage of the vehicle, thus limiting accident victim extrication options.

Another problem inherent in the stabilization of a roof-resting vehicle is that the locations most desired to place stabilization stands typically are the least conducive to a good purchase. For example, in many situations, the engine weight of the vehicle keeps the nose down and the rear end up, leaving a sloped slippery surface with little for a prop tip to engage. The rear of a typical sedan, for example, provides very few solid locations for stand engagement. Examples of areas that typically lend themselves to purchase include fender light knockouts in fenders, gas fill openings, rear trunk walls, tail light knockouts, and some bumpers or bumper supports. Often one can punch out the rear fender lights, thus leaving a hole in the fender as a purchase point.

Depending on vehicle condition, because of the collision, the presence of rust, and/or vehicle material composition, one may be able to gain a purchase sufficient to remove "play" in the vehicle. However, if vertical support is necessary, this could be a problem with sheet metal or plastic materials, particularly if the fenders provide the only available purchase. If one opens the gas fill door, one may find a good purchase there. Unfortunately, a gas fill door typically is available only on one side of the vehicle (although some models of vehicles have them on two sides, but this is a rare exception). Furthermore, if fuel is leaking, this will have to be addressed also, as setting the metal stand against a metal fender could possibly cause ignition.

The rear trunk wall usually provides a good grip for a channel-type end fitting. However, gaining access to the trunk wall often is difficult, unless the trunk lid is removed. Bumpers are another typical option, but come in many shapes and materials. Some are strong, some are weak. Bumper supports vary considerably as well. One technique, which is very quick to employ, is to place a single stand centered in the rear of the vehicle, in conjunction with step blocking or wedges in front of the 'A' posts. This provides three points of stabilization. However, two of the points, the wedges, are low relative to the center of gravity of the vehicle, and do little to increase the vehicle footprint.

Note that a roof-resting vehicle has a much lower center of gravity in comparison with a side-resting vehicle, as well as a wider footprint to start with. The use of wedges does, however, increase good solid ground contact. An advantage to this type of system is that the prop purchase is typically a solid one with the rear trunk wall or a solid bumper, and the base is well restrained. However, there are several disadvantages with this type of system. To restrain the base properly, the straps typically are hooked at either the rear posts, or run up the sides to the vehicle undercarriage. Attaching to the rear posts can, in some situations, cause difficulty in roof removal. Furthermore, straps that run up the sides in front of the doors limit access from the sides. In addition, the stand itself is centered in the rear of the vehicle, thus hampering access to the rear window.

Another known method is to apply a stand at each fender, again preferably with wedges in front of the 'A' post. With a good purchase, this can be sufficient stabilization in some cases. With this system, the base strap of one stand is connected to the opposite stand base. Disadvantages with this system include the purchase difficulties mentioned above, and the fact that the bases are not restrained completely. If the vehicle can be restrained from sliding, the lack of sideward base restraint most likely will not be an issue. An advantage to this system is that the passenger compartment is left relatively unobstructed.

Another known technique is to combine the previous two methods, thus providing a stand at both rear fenders and a stand at the rear center, along with the wedge cribbing at the 'A' post. Restraint straps can be configured in a few different ways. One strapping configuration is to strap the fender stand bases to each other independent of the rear stand, and to strap the rear stand base to the rear roof posts using 'J' hooks. Another method is to strap the rear stand to the fender stands, and then strap the fender stands to the rear post. In addition, the fender stands may be strapped to each other. In this configuration, the straps connected to the rear posts can be moved to the front of the vehicle, thus leaving the passenger compartment unobstructed. The final strap configuration noted above keeps extrication options open, however, the difficulty of finding quick and solid stand engagement remains a problem.

During a vehicle rescue situation, it is often necessary to remove the doors and/or roof of the vehicle to gain access and free patients. When the car is resting normally on its wheels, this is a simple operation with few concerns of any problems. However, when the car is resting on its roof, complete roof and door removal may lead to a failure, bending, or collapse of the floor pan which could injure the occupants and/or rescue team. One known technique for preventing such a problem is to place support stands or cribbing from the ground up to the floor pan of the vehicle, supporting the area from which the doors were removed. One problem with this approach, however, is that the support components cannot be placed until the vehicle parts (doors and/or roof) have been removed. This typically allows for a short time period with no support, which could potentially lead to a collapse. Another problem with the prior supporting technique is that it places equipment in the way of patient access and removal.

U.S. Pat. No. 6,017,170, "Adjustable Self Locking Shoring Strut", and U.S. Pat. No. 6,158,705, "Vehicle Stabilization and Support Tool" disclose examples of prior art shoring struts, which could be used with the methods of the present invention, if the prior art struts were equipped with appropriately designed end fittings (which are not shown in the patents). However, neither patent discloses a method similar to the methods of the present invention. U.S. Pat. No. 6,158,705, for example, suggests tying the base of a support tool to the vehicle, but uses only one strut and does not discuss where the strap should be attached.

Applying shoring or stabilization stands or rams (whether of wood, metal, plastic, composite or other materials and fixed in length or adjustable by manual, hydraulic, electric, pneumatic, or other means) to an object or structure in the dark, such as at night, requires sufficient lighting. Prior art techniques generally involve a hand-held light unit, such as a flashlight, spotlight or floodlight, held by the user or a second party. Another known method is to have the lighting source attached to the user's head, such as with an elastic strap, or affixed to a helmet or other headgear. Yet another known method is the provision of independent scene lighting, such as, for example, provided by a light support stand or vehicle lights.

U.S. Pub. No. 20030177645 discloses a rescue working tool having a luminescent layer on exposed portions of the tool, and preferably over the entirety of the working tool. The luminescent layer can be fluorescent, but is preferably phosphorescent so that the layer emits light when the tool is used in low light or darkness. This luminescence provides the rescue worker with a visual indication of the location and orientation of the working tool as it is being used. Thus, in the case of a saw blade, the luminescent blade would be visible to the worker, even in total darkness, so the worker can gauge the location and extent of a cutting operation. If the working tool is a drill, the luminescence can provide a visual indication of the depth that the drill bit has penetrated the subject structure.

U.S. Pub. No. 20030043581 discloses a combination vehicle jack and directable light source. The light source provides one or more beams of light, which are independently directable, relative to the base of the jack. The light source may be battery powered, pivotal, flexible, and/or detachable.

U.S. Pat. No. 6,695,289 discloses a motorized scissor jack including upper and lower limit switches. The jack can also include a directionally adjustable light, having an inline switch positioned on the upper structure proximal to the lifting plate, and is connected with the switch system. The adjustable light is configured to provide critical lighting for aligning the lifting plate with the chassis of the vehicle at night or during inclement weather. In one preferred embodiment, the light is a separately battery powered removably positionable assembly.

U.S. Pat. No. 6,357,724 discloses an automatic lifting device (i.e., a jack) with a light module. A selected component of the jack is attached with a light module providing light at the front lifting end of the jack. The light module is attached to the jack by magnetic attraction, adhesive, clamping, snapping on, pressing in, locating in, embedding, screwing, etc., so that a sufficient illumination is provided at the correct position to the supporting point for an object to be lifted by the jack. The light source of the light module is pivotally connected to the body of the light module. Further, the light source of the light module is freely adjustable, so the orientation of the light source is also adjustable, thus providing the correct illumination at the correct position.

U.S. Pat. No. 6,357,724 discloses a motorized jack for reducing the amount of labor needed to lift up a vehicle. A light source (such as a light bulb or an LED) is provided in the housing adjacent the window portion. This permits shining of light from the light source out of the housing through the window portion to illuminate the area around the lifting head, so that a user can properly position the lifting head under an object in low light conditions.

U.S. Pat. No. 4,872,230 discloses a portable automatic automobile jack that includes an electrically powered automobile tire nut remover, optionally including a light source, so that the work area is illuminated at night.

U.S. Pat. No. 2,219,903 discloses a portable jack including a system for providing illumination to the work area.

Prior art lighting methods and apparatus require additional time, manpower, space, and often fail to light the desired area sufficiently. However, rescue situations typically demand speedy results. Additionally, space and manpower often are limited. Therefore, the known lighting means suffer from various drawbacks and therefore fail to provide adequate lighting means for rescue situations.

SUMMARY OF THE INVENTION

The present invention provides methods and apparatus for stabilizing a roof-resting motor vehicle, which are useful for emergency rescue workers who must stabilize a damaged vehicle and assist in removing the accident victims. More particularly, the invention provides methods and apparatus for universal stand engagement at fenders, independent of vehicle construction, material, and design, and further provides for keeping patient access free from obstruction, leaving all possible extrication options available. The invention provides solid vehicle stabilization, is simple to understand, and quick to set up.

According to a preferred aspect of the present invention, herein is disclosed an improved method for stabilizing a roof-resting vehicle, which includes the steps of leaning one or more buttress stands, each preferably having chain-grab end fittings or other suitable attaching means, against a fender area of the vehicle, passing a chain or other suitable fastening means under an end of the vehicle from one of the buttress stands to another (if more than one stand is used), with slack extending up to the vehicle's undercarriage on each side of the vehicle, tightening the slack from the chain or other suitable fastening means by pulling the chain-grab end fittings or other suitable attaching means towards the fenders at the vehicle undercarriage or lower side of the vehicle, using a ratchet strap or similar tightening means, optionally restraining the chain or other suitable fastening means from sliding off the end of the vehicle by attaching a ratchet strap or similar tightening means to the chain or other suitable fastening means near the vehicle, and passing the chain or other suitable fastening means up to the vehicle undercarriage in front of a wheel assembly of the vehicle, attaching a ratchet strap or similar tightening means at a base of the one or more buttress stands and tightening, and optionally placing wedges in front of each roof support post, such that the vehicle is stabilized.

An advantage of the present invention is that it provides quick, simple means for stabilizing a vehicle, requires no search for prop purchase, and leaves the passenger compartment free from obstruction, thereby keeping multiple access options open for rescue personnel.

According to another preferred aspect of the present invention, herein is disclosed an improved method for stabilizing a damaged vehicle, which includes the steps of placing one or more beam-like structures at the floor pan or vehicle undercarriage, such that the structure is aligned substantially parallel with the length of the vehicle, and securing the structure to the vehicle at one or more points, such as by means of hooks, straps, chains, or similar securing means. An advantage of the invention is that it provides reinforcement to the weakened vehicle undercarriage to assist in preventing its collapse.

According to yet another preferred aspect of the present invention, herein is disclosed an improved buttress stabilization stand or shoring stand having an integrated (interior and/or exterior) lighting means for providing improved lighting to the work area and/or rescue scene. The stabilization or shoring stand on-board lighting has the advantages of: 1) providing base lighting to find a suitable footing for the stand in the dark; 2) providing peripheral base lighting for attachment of base restraints, straps, chains, stakes, nails, ropes, etc.; 3) providing buttress stand lighting directed axially upward and/or peripherally, such as for the purpose of locating an adequate purchase point on a vehicle, structure, or other object in the dark; and 4) providing scene area lighting local to the stabilization stand to illuminate surroundings, prevent trip hazard, aid in monitoring stabilization in the dark.

These and other features and advantages will become readily apparent from the following Detailed Description, which should be read in conjunction with the accompanying drawings.

DETAILED DESCRIPTION OF THE INVENTION

Figure 1:
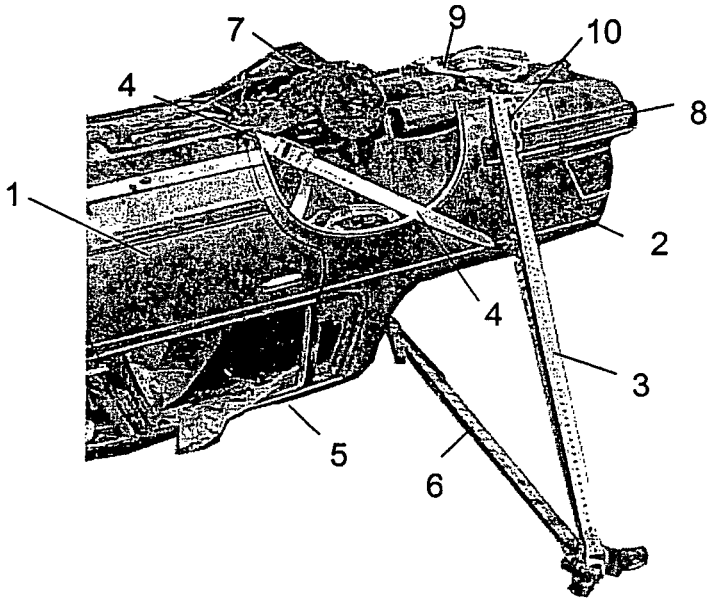
FIG. 1 shows a side view of a vehicle stabilized by one embodiment according to the invention.
Figure 2:
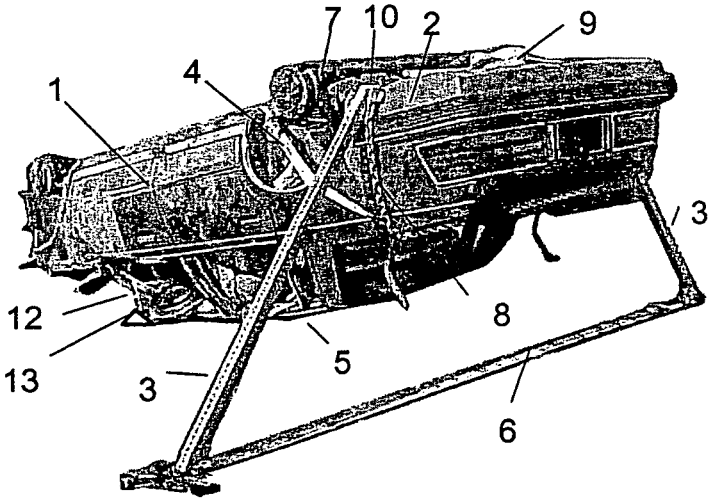
FIG. 2 shows a rear quarter view of a vehicle stabilized by an embodiment according to the invention.
Figure 3:
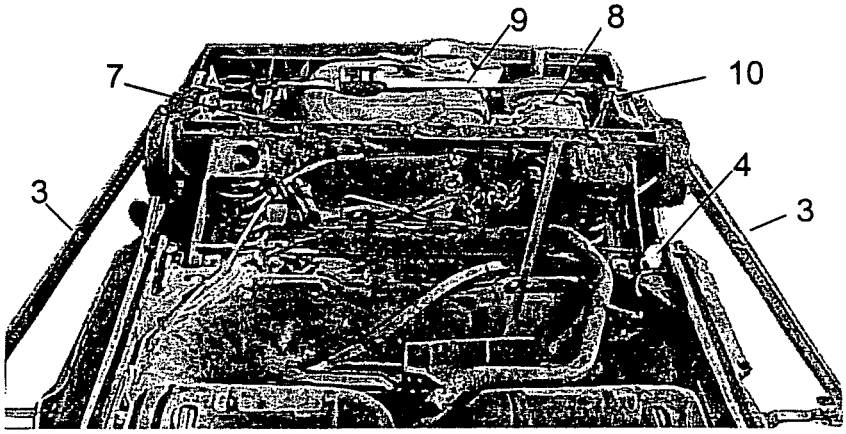
FIG. 3 shows a view of the undercarriage of a vehicle stabilized by an embodiment according to the invention.
Figure 4:
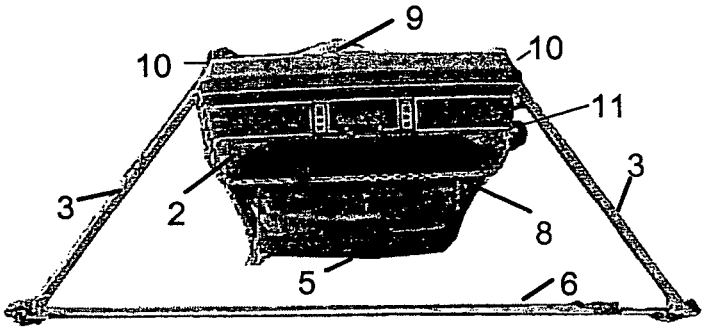
FIG. 4 shows a rear view of a vehicle stabilized by an embodiment according to the invention.
Figure 5:
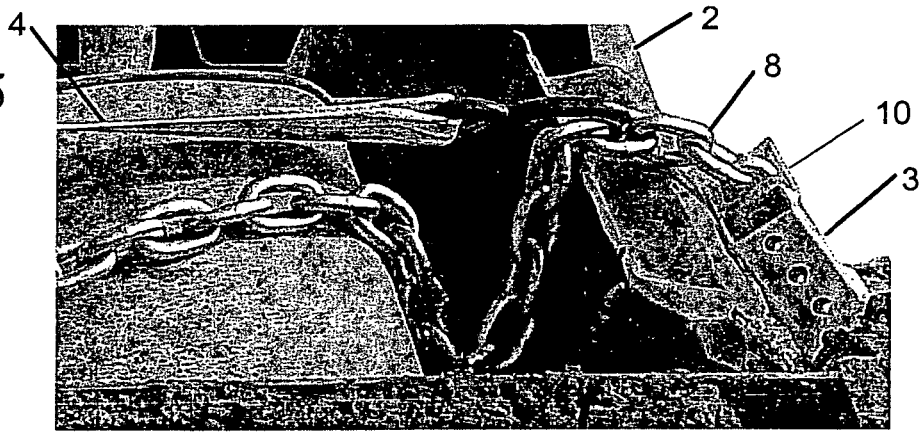
FIG. 5 shows a detail view of the undercarriage of a vehicle stabilized by an embodiment according to the invention.
Figure 6:
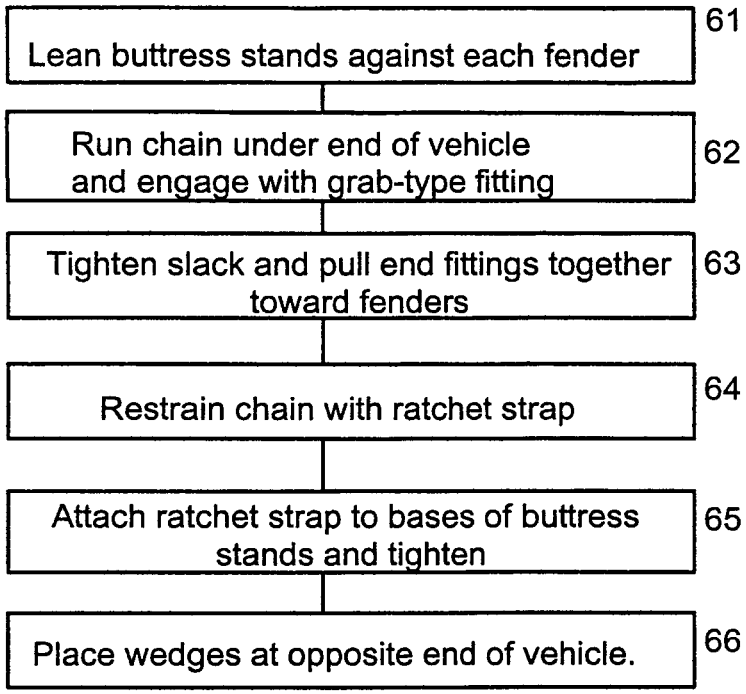
FIG. 6 shows a flowchart of the method of an embodiment according to the invention.

As detailed in the flowchart of FIG. 6, and as shown in FIGS. 1 through 5 and 10 through 12, an embodiment of the present invention involves generally the following steps:

(61) lean buttress stands (3) preferably with special chain grab end fittings (10) preferably against each fender (2) on an end of the vehicle (1), with the bases spaced outward from the vehicle to form a stable angle.

Figure 10:
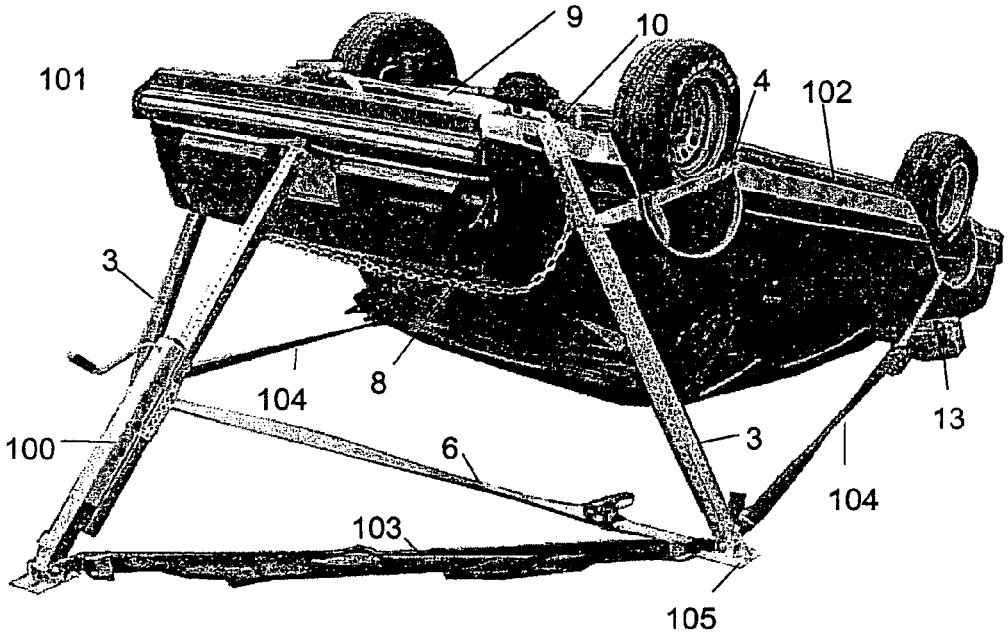
FIG. 10 shows a vehicle stabilized by an embodiment according to the invention, using three buttresses.

Stand, buttress, strut, adjustable stand, cribbing post, post, and jack stand may be used interchangeably to describe the rigid member extending from the vehicle down and outward to the ground. The stands optionally are adjustable on fixed increments, such as jack stands, or include a lifting means, or consist simply of timber posts, for example. This member may be of a fixed length, although the length is preferably adjustable. The buttresses (3) in FIGS. 1-4 and 11, and jack-type buttresses (120) in FIG. 12 or (100) in FIG. 10 are all adjustable, either by pinned telescopic sections or the same combined with a jack. The member length may be adjusted by various means: manually, mechanically, pneumatically, electrically, or otherwise—as, for example, by jack handle (121) shown in FIG. 12. Depending on the adjustment method of the particular buttress, the length may or may not be adjusted under a loaded condition—a jack, for instance, can be adjusted in length while under load, while a buttress with pinned holes would not. While the stands shown all are adjustable in length, stands may be of fixed length, as well as constructed of timber, metal, etc.

Figure 11:
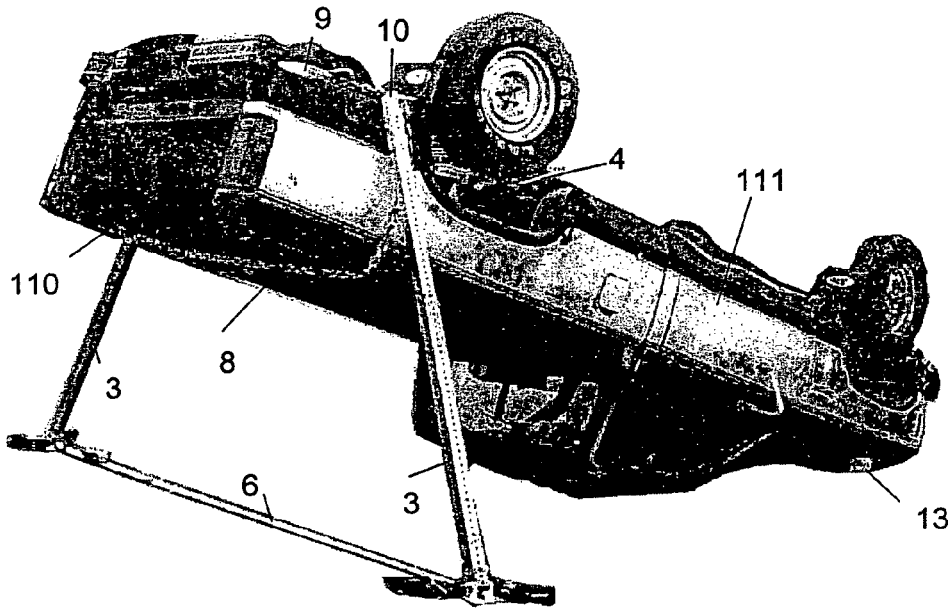
FIG. 11 shows an embodiment according to the invention used with a pickup-truck type vehicle.
Figure 12:
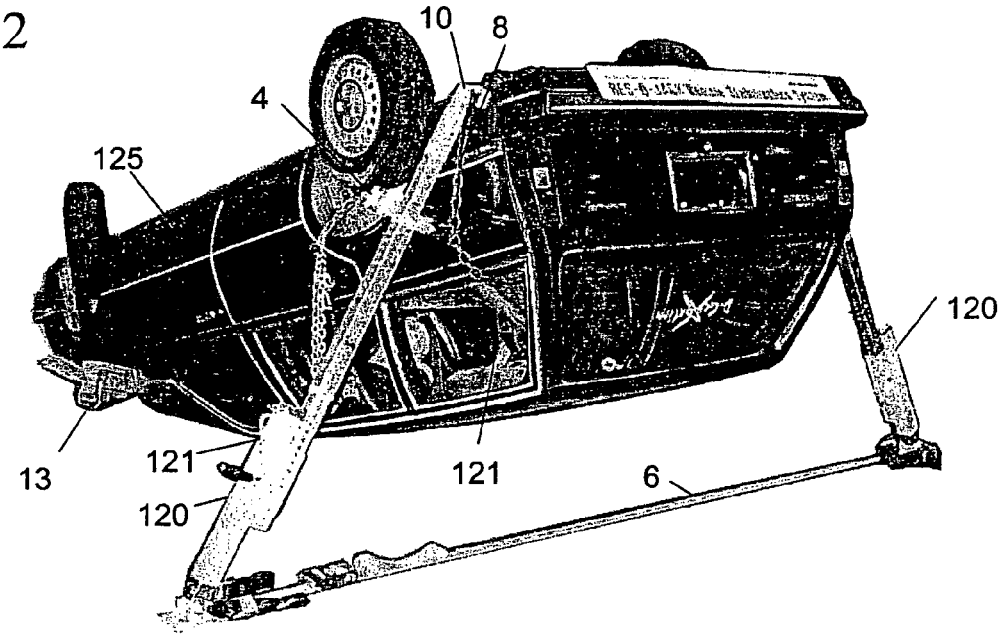
FIG. 12 shows a hatchback-type vehicle stabilized by an embodiment according to the invention, using jack-type buttress stands.

Note that while this method might normally be used at the rear end of the vehicle, as shown in the figures, because of the tendency of the weight of the engine to pull the front of the vehicle down, it will be understood that the method of the invention is equally applicable to situations where the front end of the vehicle needs to be stabilized and the trunk is down, with other types of vehicles such as the pickup truck shown in FIG. 11 or the hatchback of FIG. 12, or convertibles or tractors which do not have roofs, or where the vehicle is in other positions than resting on its roof, as perhaps on its side.

Figure 8A:
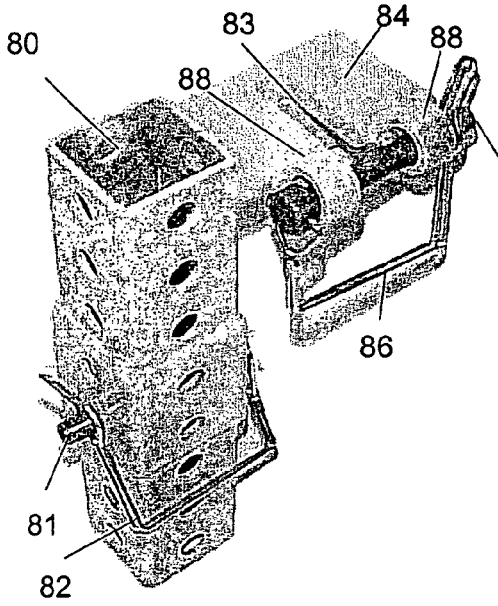
FIG. 8*a* shows an embodiment of a chain-grab end fitting according to the invention.
Figure 8B:
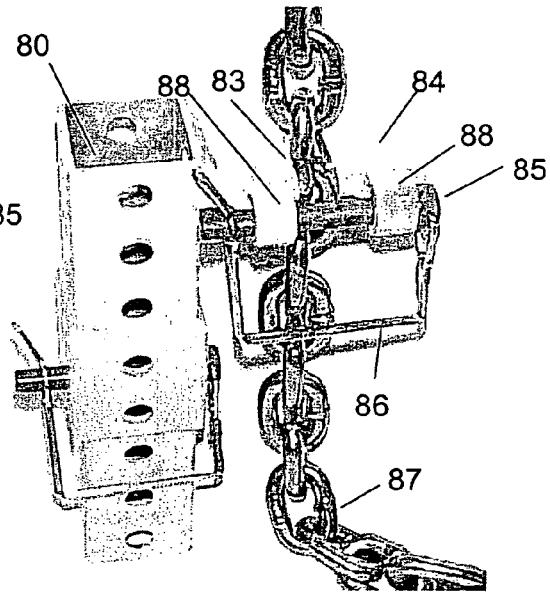
FIG. 8*b* shows an embodiment of the chain-grab end fitting of FIG. 8*a*, with a chain engaged.
Figure 8C:
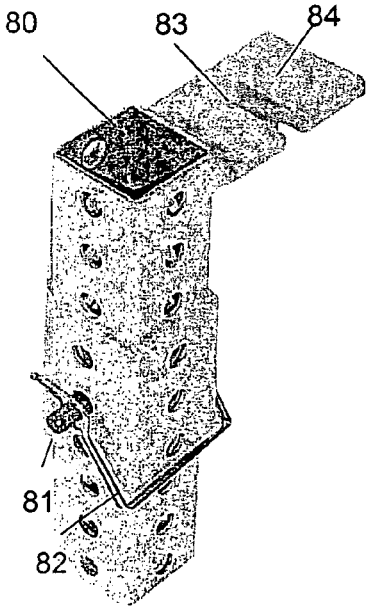
FIG. 8*c* shows another embodiment of a chain-grab end fitting according to the present invention.

FIGS. 8*a*, 8*b* and 8*c* show an embodiment of a chain-grab end fitting (10) which would be suitable for use with the method of the invention. The end fitting body (80) fits within the end of the buttress stand, and is held in place by a pin (81) which runs through holes in the body (80) and stand. Provision of a number of holes permits a range of length adjustment of the buttress stand. A keeper (82) prevents the pin (81) from pulling out inadvertently. A grab plate (84) is attached to the body (80), and has a slot (83) into which a link of chain (87) can fit. Since the slot (83) is only the width of the link of chain, the next link will wedge against the plate (84) and hold the chain in place. In the variation shown in FIGS. 8*a* and 8*b*, a stopper pin (85) is slipped into loops (88) and secured with keeper (86), to keep the chain (87) from slipping out of the slot (83). FIG. 8*c* shows a simpler variation which omits the pin (85) and loops (88).

Figure 9:
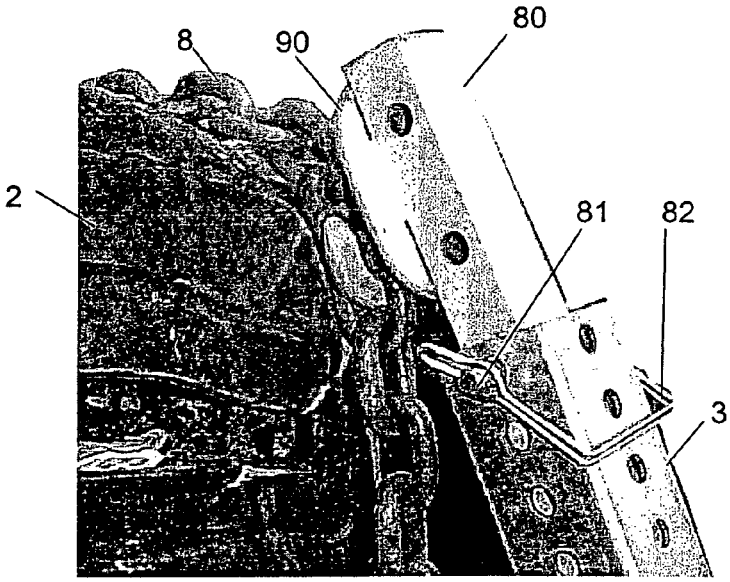
FIG. 9 shows still another embodiment of a chain-grab end fitting, in use on a stabilized vehicle.

FIG. 9 shows another embodiment of the chain-grab end fitting, in use engaging a chain (8) against a vehicle fender (2). Like the other embodiments shown in FIGS. 8*a*-8*c*, it has a body (80) secured to the buttress stand (3) by pin (81), held in by keeper (82). In this embodiment, the chain (8) is held by a split chain link (90) welded to the body (80). The chain (8) is hooked by the split link (90) and thereby secured against the tension.

Figure 13:
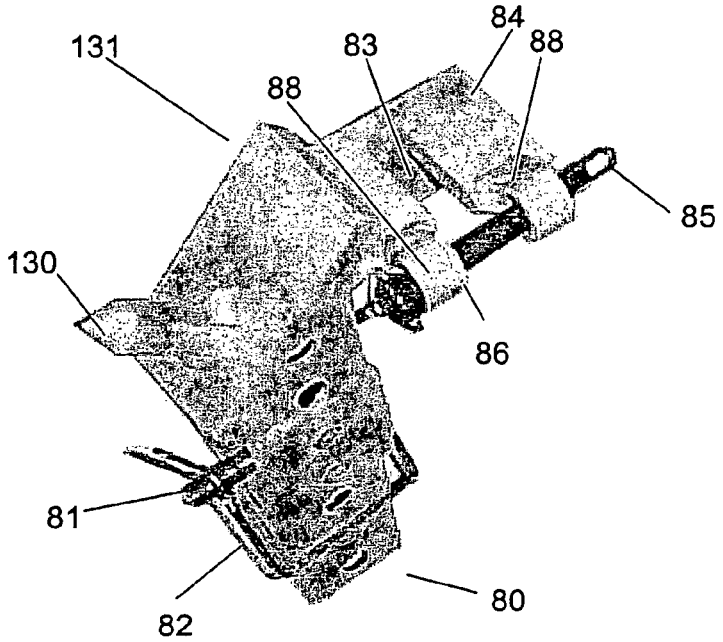
FIG. 13 shows an alternative embodiment of a chain-grab end fitting according to the invention, combined with another fitting.

FIG. 13 shows yet another embodiment of the chain-grab end fitting, combined with another type fitting having a round-point fitting (130) on an angled plate (131). The round-point fitting can be inserted into factory knockouts in vehicle frames, bolt holes, or other openings when the stand is used in other applications. The round-point fitting could also be a channel, chisel point, angle, etc.—whatever other function might be desired to be combined with the chain-grab end fitting. The other elements of the chain-grab end fitting are as discussed above.

(62) run chain (8) from one end fitting to the other under the end (hood or trunk lid (11), or pickup truck bed (110) of the vehicle (1) from one stand (3) to the other with slack extending up to undercarriage (7) on each side. If necessary, as shown in FIG. 12 with a hatchback vehicle (125), it may be necessary to break out the side windows (121) and run the chain (8) through the cargo area. The same would be true of sports-utility vehicles (SUVs), station wagons, vans or other similar vehicles, which have a roof extending to the rear of the vehicle and no horizontal rear deck or trunk It will be recognized by one skilled in the art that most modern vehicles lack classic fenders as that term traditionally is defined, however, the terms "fender" and "fender area" are used herein to describe generally a side body panel of a vehicle, which typically is located near the wheels and may include, for example, fenders, wheel wells, cutouts, as well as other similar structures.

Note that in the context of the invention the term "chain" is meant to encompass literal chains, as well as straps, ropes, cables, slings, wires, etc.—the terms are used interchangeably to refer to a flexible or semi-flexible tie member which may be attached to two or more points;

(63) tighten slack and pull end fittings (10) to fender (2) using a ratchet strap (9) from one end of chain (8) to other end of chain at undercarriage (7).

Note that the term "ratchet strap" is meant to include any adjustable-length flexible member, such as straps with ratchet adjusters, as well as locking straps, "come-alongs", turnbuckle straps or chains, or other similar arrangements. The length of the flexible member may be adjusted between said points to cause a change in the tension in that member by means of a cam-buckle, ratchet, binder, turnbuckle, come-along, or similar device for tightening.

(64) restrain chain (8) from sliding off end of vehicle by attaching a ratchet strap (4) to chain (8) near the trunk lid (11) or other horizontal surface such as a pickup truck (111) cap or bed (110) in FIG. 11, (or the hood, if the front end of the vehicle is being stabilized) and running up to undercarriage (7) in front of wheel assembly (swing-arm pivot point may be suitable).

With a typical sedan it is preferred to place the stands and straps/chains on both sides to be sure the chain cannot slip over the rear of the vehicle at any location. However, with an SUV, hatchback, or wagon type vehicle you have a roof post at the very back of the vehicle. If you break the windows and pass through here with the chain there may be no need to use the above referenced tie members on either side unless vehicle condition requires it. I recommend it always be done on both sides as a practice such that it becomes a standard procedure that will not be left out when needed, however, technically it can be done on both sides or one side only.

(65) restrain bases from sliding in all directions by any means or combination thereof. For example, attach a ratchet strap (6) to bases of buttress stands (3) and tighten, or alternatively, for example, stake each base to the ground; and (66) if needed, place wedges (13) or similar in front of each roof support post at the opposite end of the vehicle ("A" pillar (12) or hood or front of roof, if the rear is raised, or rearmost pillar, if the front is raised).

In practice, execution of the above steps takes only about two minutes to accomplish. There is little thinking required in terms of deciding how to set the stands, how to gain purchase with the vehicle, or how to keep stabilization from interference with patient access/extrication.

If a third stand is desired at the rear center of the vehicle, it optionally can be added at any time, as shown in FIG. 10, where a jack-type stand (100) is used to support the bumper (101) of car (102). In this case, straps (103) may be attached from the third stand (100) to the bases (105) of the fender stands (3).

Also note in FIG. 10 the additional straps (104) running from the bases (105) of fender stands (3) to the opposite (front) end of the car (102). This configuration would keep the passenger compartment free from strap attachment.

A situation could arise where one side of the vehicle is otherwise supported either because obstructions demand a different support on that side or the way the vehicle came to rest provided that support The chain could still be wrapped around in the same fashion, and a stand applied at only one side. The base of this stand could be attached to an object on the opposite side of the vehicle. Alternately, if the stand were a jack stand which is capable of self-tightening, the base of the stand could be "picketed" or staked in place or otherwise prohibited from movement by a strap or other means.

Figure 7:
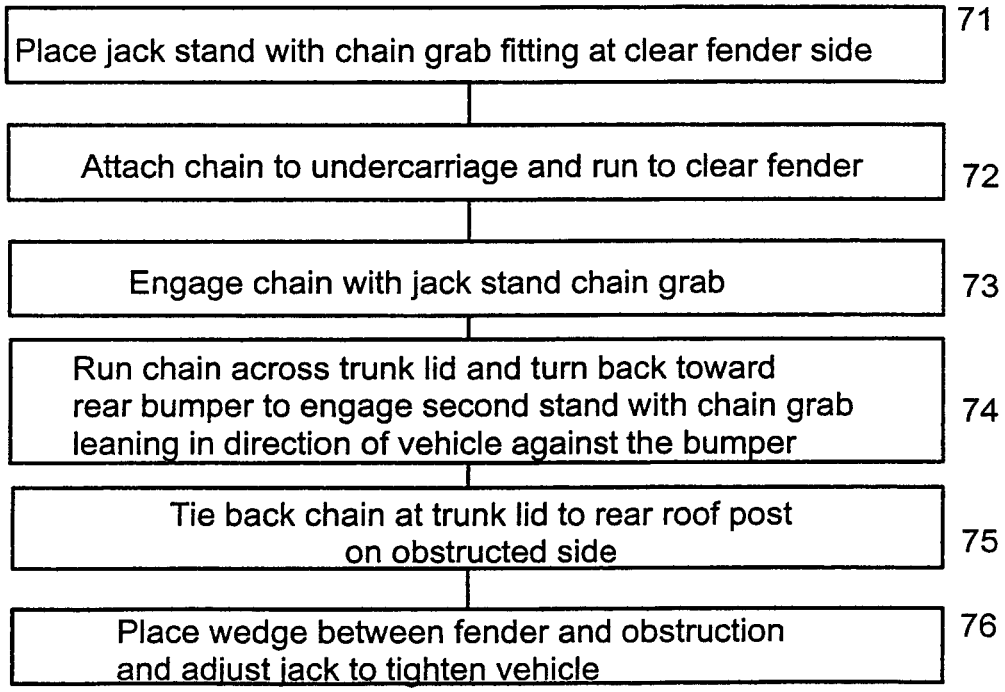
FIG. 7 shows a flowchart of an alternative embodiment according to the invention.
Figure 14:
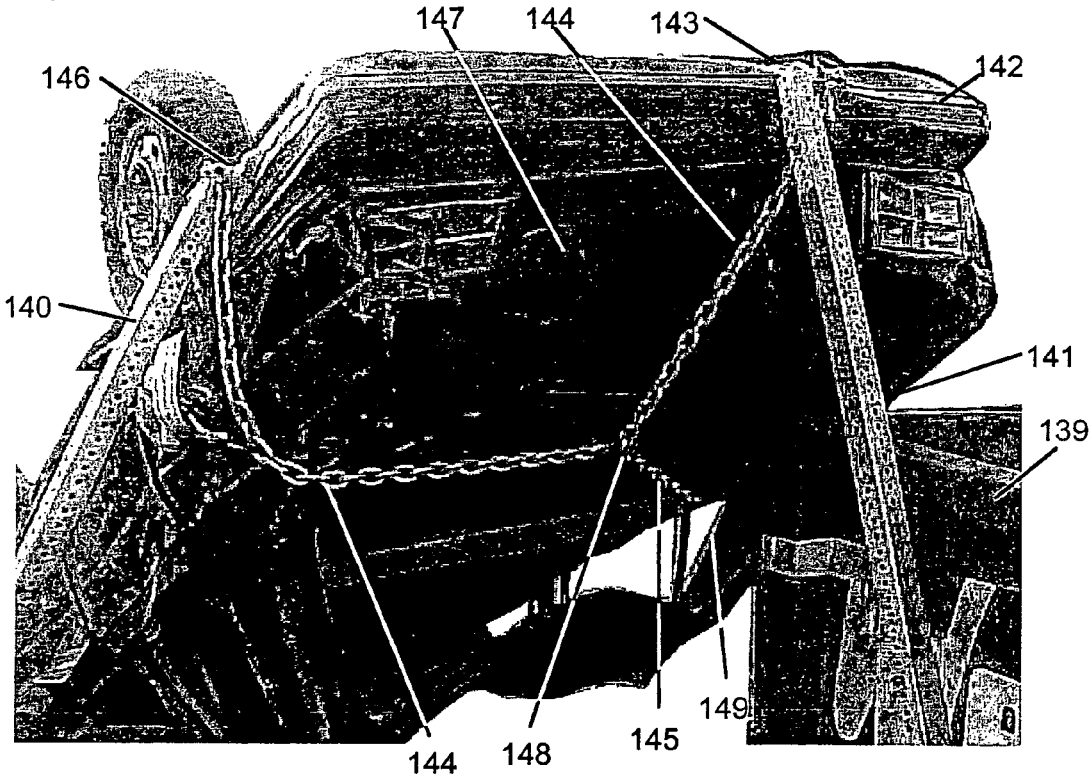
FIG. 14 shows an alternative embodiment according to the invention, using a tensioned and restrained chain.

There are other possibilities—wherever one can place a tight chain, one can place a stand with a chain grab end fitting. For example, assuming a car is resting on its roof beside an obstruction (e.g., a building or other object, such as the dumpster (139) shown in FIG. 14), which would prevent placing a stand at one of the fenders. The other fender is clear. The bumper stand (141) offers vertical support. It may be a jack stand staked to the ground and adjusted to tighten, or an adjustable stand with ratchet strap for tightening. Here is how it would be set up (referring to the flowchart of FIG. 7, and the view of FIG. 14):

(71) place a jack stand with chain grab fitting (140) at clear fender side.

(72) attach chain (144) to undercarriage and run towards clear fender.

(73) engage chain with jack stand (140) chain grab (146).

(74) run chain (144) across trunk lid (147) and turn back towards rear bumper (142) to engage second stand (141) with chain grab (143) leaning in direction of vehicle against the bumper (142).

(75) tie the center of the chain back to the rear roof post (149) on the obstructed side with a second chain or strap (145), creating a corner (148) in the chain (144) on the trunk lid (147).

(76) place a wedge between car fender and obstruction and adjust jack of step (71) to tighten vehicle against obstruction.

Figure 15:
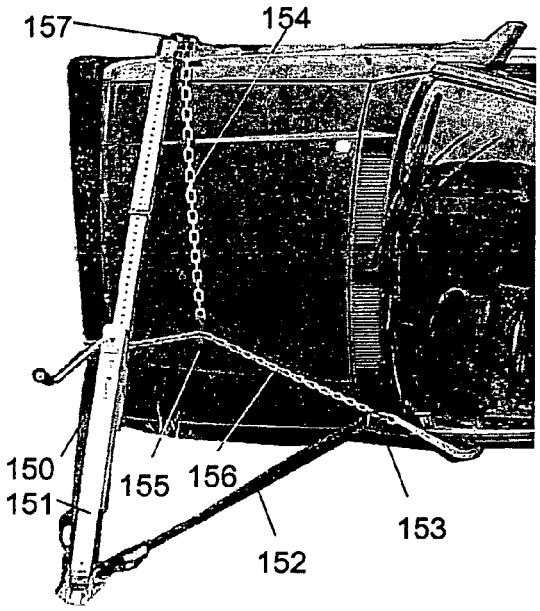
FIG. 15 shows an alternative embodiment according to the invention, with a single stand on one side of the vehicle.

Alternately, if the obstruction does not prevent a full wrap of the chain around the tail end (or front end), the chain could be placed and a loop possibly taken off of it. FIG. 15 shows a car supported in this fashion, which is another application of a restrained and tensioned chain. The "chain" here refers to the chain (156) we wrap around the tail end of a vehicle and restrain in our preferred technique described in FIG. 6. This chain would serve as a foundation from which to build. For example, another chain (154) could be attached to this restrained chain (156) with hook (155). The new chain (154) could come up and attach to the stand (151) at the chain grab end fitting (157). Note that the chains (154)(156) serve as purchase for not only the end fitting (157) but also the straps (150)(152)—the latter attaching to chain (156) at hook (153).

Figure 16:
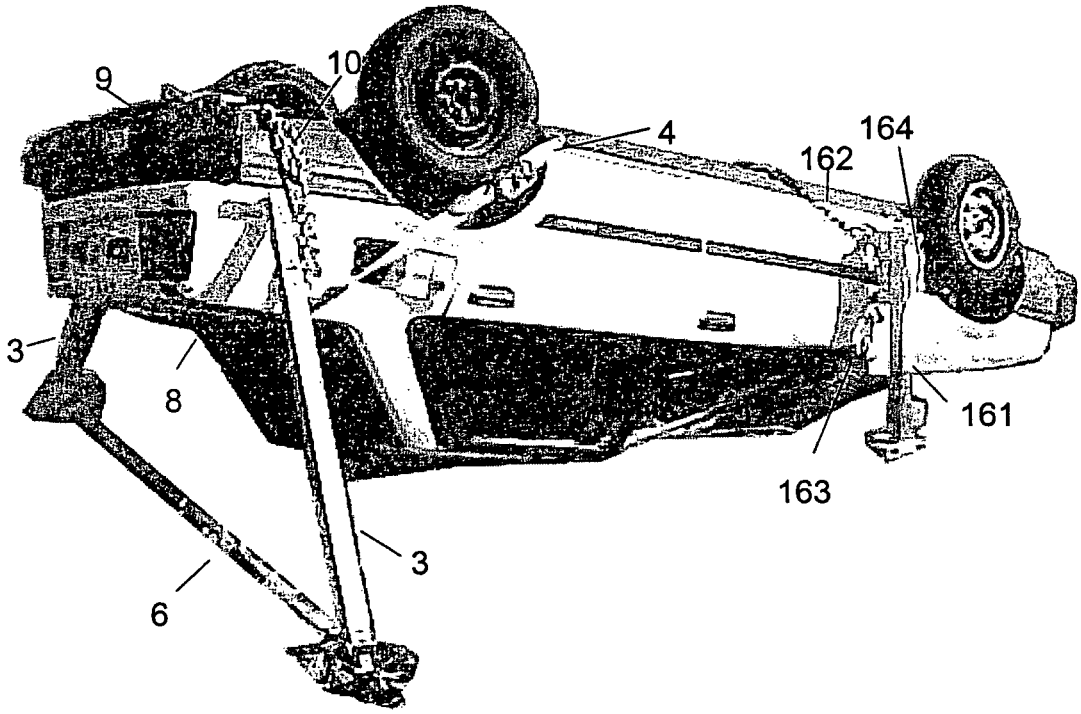
FIG. 16 shows a vehicle stabilized by an embodiment according to the invention, with a jack used to lift the vehicle to free an occupant.

FIG. 16 shows a jack (161) to be used along with a chain grab fitting (164) and chain (162)(163) to perform low-level lifts of objects. In this configuration, the device may be useful in lifting a roof-resting car off the ground to free a patient trapped beneath, in lieu of setting up air lift bags.

Figure 17:
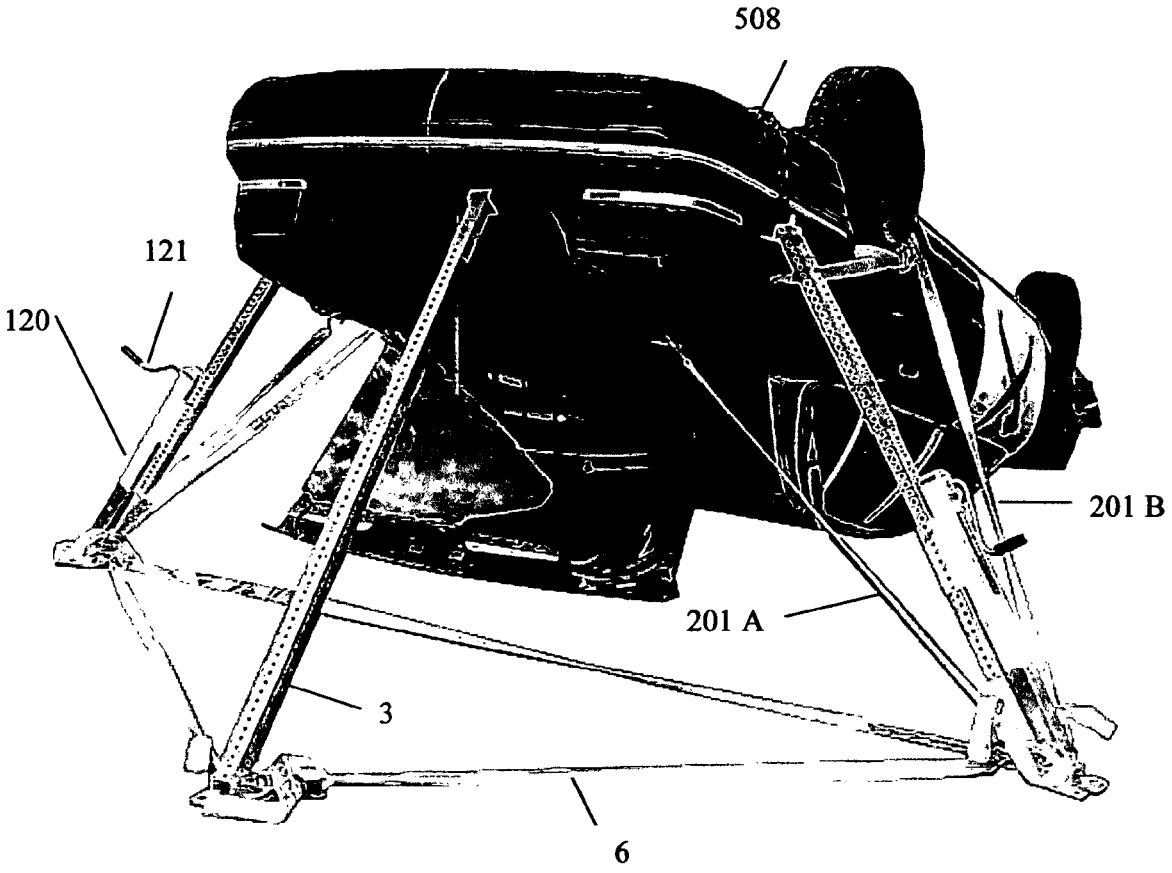
FIG. 17 shows an alternative embodiment according to the invention, including the additional step of adding sway straps.

Our research in the area of buttress stabilization of a roof-resting vehicle has led to improvements as well as alternative methods, which in many cases simplify and quicken the stabilization process. We have discovered through such research that, while the foregoing methods are a great improvement over any prior means, there are improved derivatives of the technique, which are equally valuable in saving time and producing a stable working environment Referring now to FIG. 17, one improvement is the addition of two more flexible members (201A, 201B) or "sway straps" attached from the base of the stand (3) up to the chain saddle (508). The need for these two members arises when lifting of the vehicle is involved. When the vehicle is left unelevated from its roof-resting positions, typically the standard method provides adequate stability. However, once the vehicle is elevated, the vehicle may be less stable, because the shape created by the two stands, the vehicle and the base-to-base strap (6) is a trapezoid. Such a shape is inherently unstable. This allows for the ability of the vehicle to sway with the potential for it to cause further complications. Adding the extra sway strap (201A, 201B) at each base, from the base up to the chain at the fender/trunk corner, in effect creates a triangle at each side of the vehicle, thus eliminating or at least decreasing the amount of freedom the vehicle has to sway.

Figure 18:
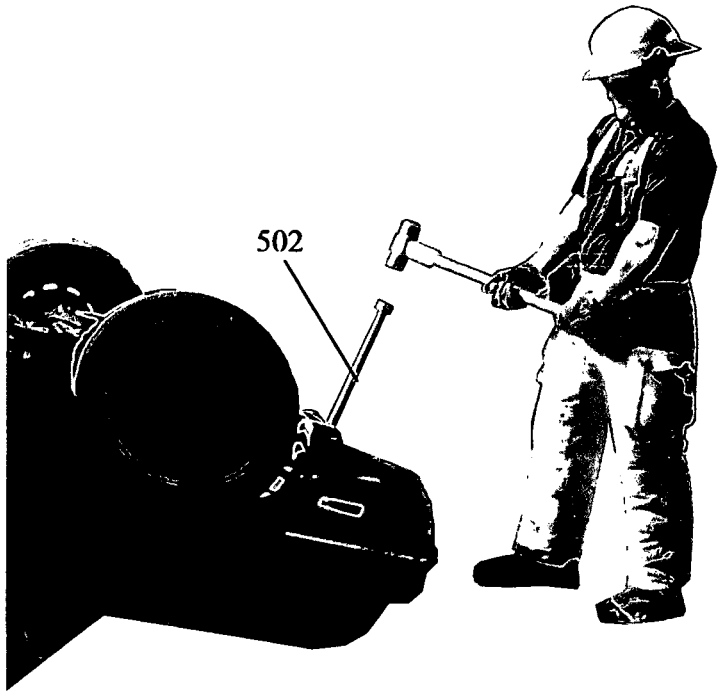
FIG. 18 shows an alternative embodiment according to the invention, including the additional step of staking the hood.

Referring now to FIG. 18, another unique concept in the area of roof-resting vehicle stabilization is the method of "staking" the hood of the vehicle to the ground to prevent front to back movement of the vehicle. This new technique decreases the amount of equipment required and greatly speeds up the process. The method involves placing a stake through the engine compartment and driving the stake (502) through the vehicle hood area into the ground.

We have developed several alternate methods of creating a chain or similar flexible member type purchase with a roof-resting vehicle for the purpose of buttress stabilization. These include the Rear Post Chain Wrap method, J-Hooking the Rear Post, J-Hooking the Side-Wall, and J-Hooking the Rear Deck, each of which is described below in detail.

While the figures and description herein show attachment of the chain to the rear post for the purpose of illustration of the methods, the invention contemplates alternatively attachments to other posts, such as a front or middle post.

Figure 19:
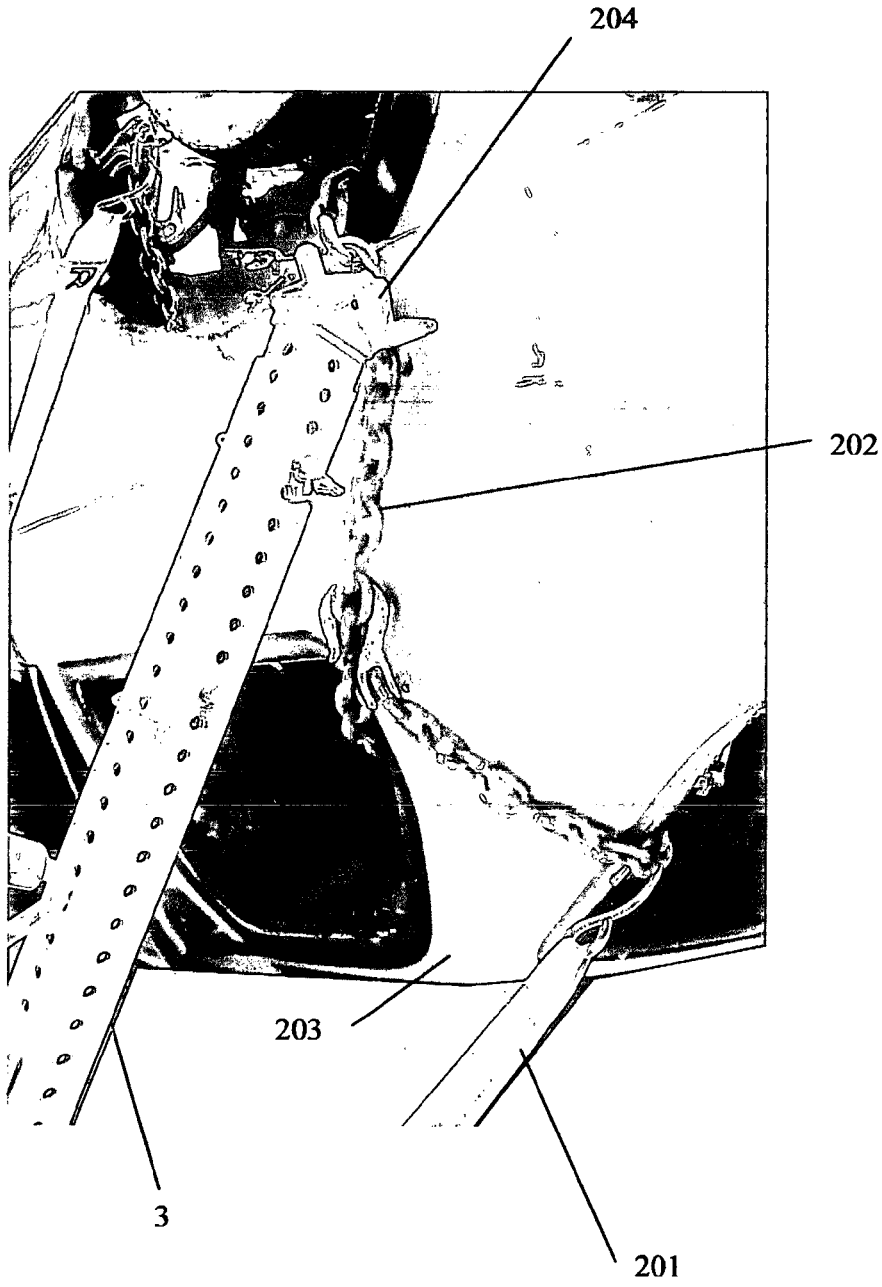
FIG. 19 shows an alternative embodiment according to the invention, including the rear post chain wrap step.

Referring now to FIG. 19, one alternative method is to wrap a chain (202) around a roof post, preferably the rear-most post (203) like a noose and bringing one end of the chain up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass across the trunk lid of a sedan type vehicle, thus allowing trunk access. This method also eliminates the need for a chain saddle to pass across the rear window of a hatchback, which is often a critical patient access point. This method also involves far fewer components than the standard method. It preferably involves the two buttress stands with chain grab type end fittings, the base to base restraint chain or strap, as well as a chain wrap at each post which can be accomplished using a single chain. If lifting or additional stability is desired, one may incorporate the two optional sway prevention straps (201).

Figure 20:
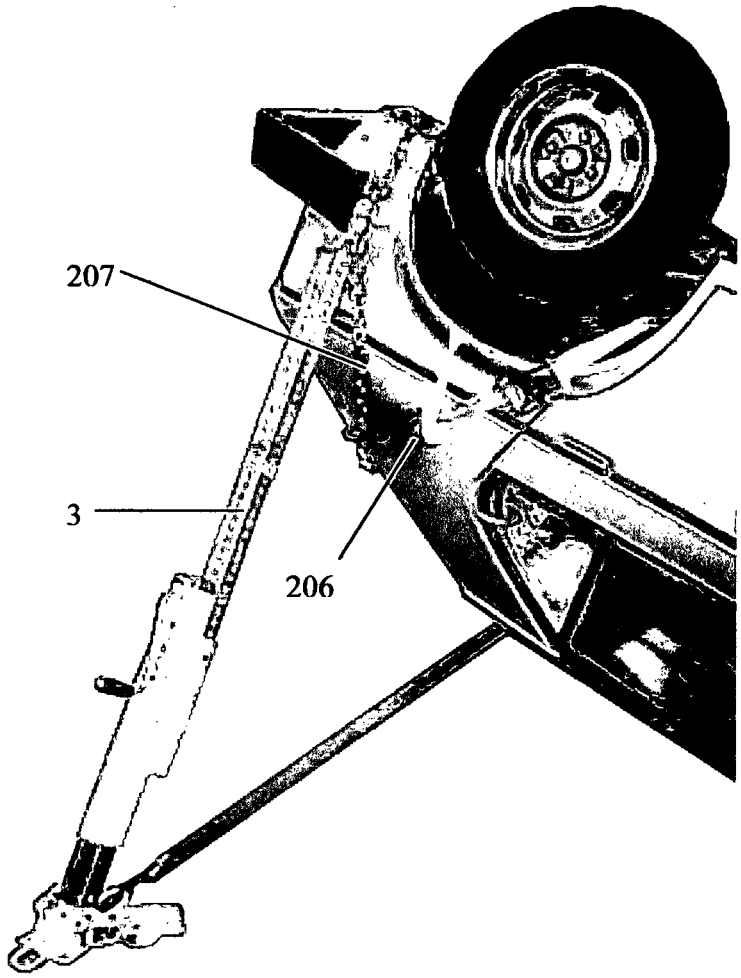
FIG. 20 shows an alternative embodiment according to the invention, including the step of J-hooking the rear post.

Referring now to FIG. 20, another alternative method is to enter through the rear window (not shown in FIG. 20) of an inverted vehicle and attach a large J-hook (206) to the post. Alternatively, one can pass through a side window and attach to any post. A chain (207) is then attached (if not a chain/J-hook assembly) to the J-hook and brought up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass across the trunk lid of a sedan type vehicle, thus allowing trunk access. This method also eliminates the need for a chain saddle to pass across the rear window of a hatchback, which is often a critical patient access point. This method also involves fewer components than the standard method. It preferably involves the two buttress stands with chain grab type end fittings, the base to base restraint chain or strap, as well as a J-hook/chain attachment at each post. If lifting or additional stability is desired, one may incorporate the two optional sway prevention straps (201).

Figure 21:
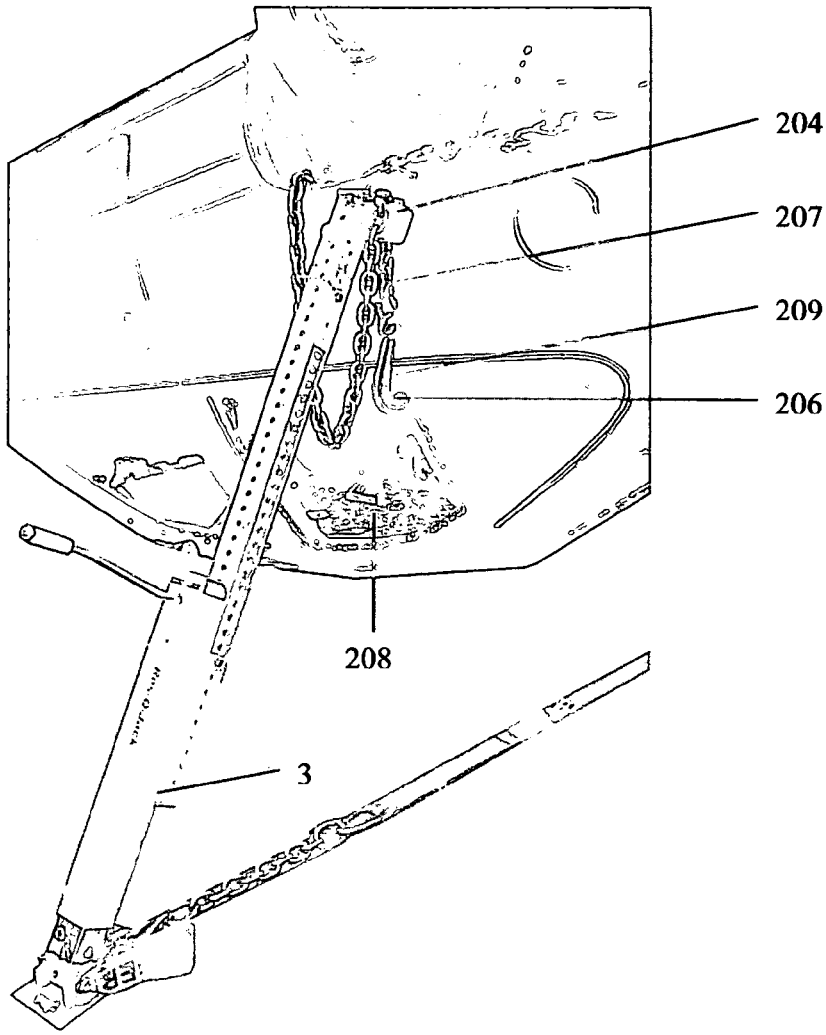
FIG. 21 shows an alternative embodiment according to the invention, including the step of J-hooking the sidewall.

Referring now to FIG. 21, another alternative method is to enter through the side window (208) of an inverted vehicle and attach a large J-hook (206) to the sidewall (209). A chain (207) is then attached (if not a chain/J-hook assembly) to the J-hook and brought up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass through the passenger compartment of an SUV, minivan, or wagon vehicle. This method also eliminates the need for a chain saddle to pass across the trunk lid of a sedan type vehicle, allowing trunk access. This method also eliminates the need for a chain saddle to pass across the rear window of a hatchback, which is often a critical patient access point. This method also involves fewer components than the standard method. It preferably involves the two buttress stands with chain grab type end fittings, the base to base restraint chain or strap, as well as a J-hook/chain attachment at each post. If lifting or additional stability is desired, one may incorporate the two optional sway prevention straps (201).

Figure 22:
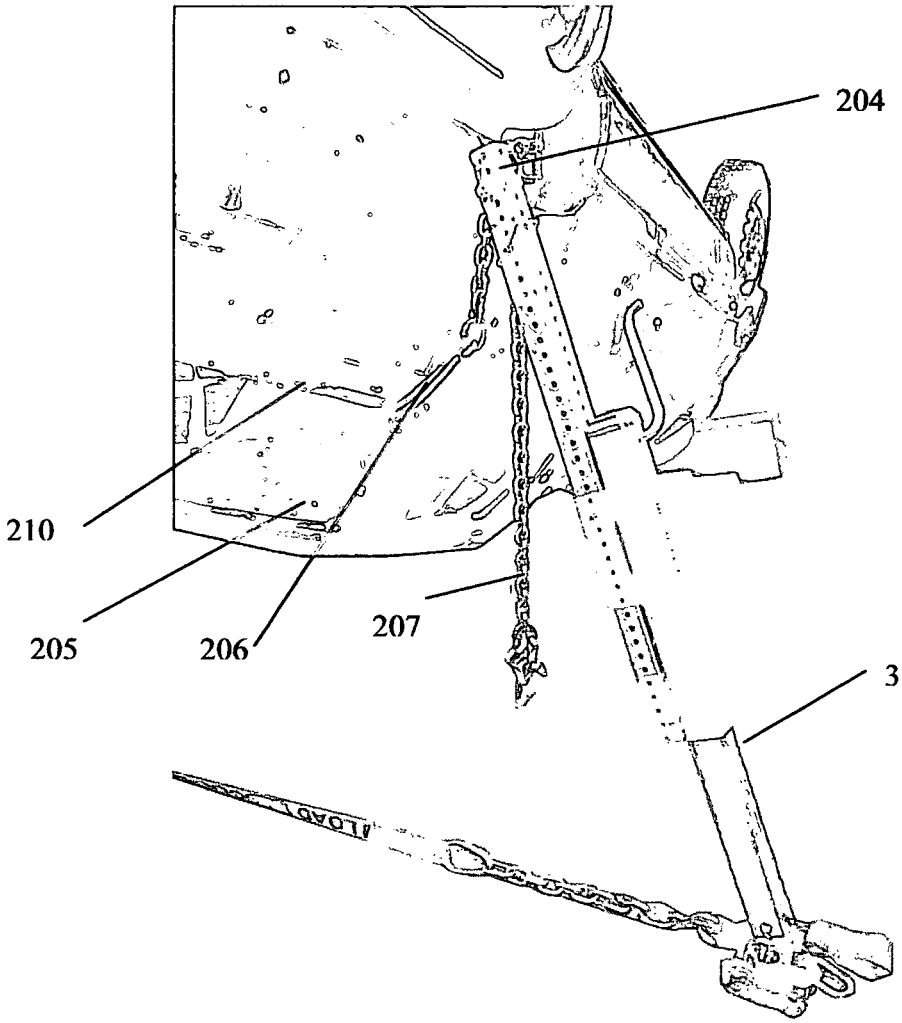
FIG. 22 shows an alternative embodiment according to the invention, including the step of J-hooking the rear deck.

Referring now to FIG. 22, another method is to enter through the rear window (205) of an inverted vehicle and attach a large J-hook (206) to the rear deck (210) or speaker deck. A chain (207) is then attached (if not a chain/J-hook assembly) to the J-hook and brought up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass through the passenger compartment of an SUV, minivan or wagon vehicle. This method also eliminates the need for a chain saddle to pass across the trunk lid of a sedan type vehicle, allowing trunk access. This method also eliminates the need for a chain saddle to pass across the rear window of a hatchback, which is often a critical patient access point. This method also involves fewer components than the standard method. It preferably involves the two buttress stands with chain grab type end fittings, the base to base restraint chain or strap, as well as a J-hook/chain attachment at each post. If lifting or additional stability is desired, one may incorporate the two optional sway prevention straps (201).

Prior art techniques for making a purchase with a vehicle using round pin type or round point end fitting typically involve the use of pre-existing holes or the violent action of piercing a hole. Pre-existing holes in a vehicle provided by the manufacturer are not always readily available or in the needed location. The act of piercing a hole with a tool, such as a Halligan tool, for example, is a violent and loud action, which has the potential to further complicate the accident scene. A pierced hole may also have a tendency to tear under load.

Figure 23A:
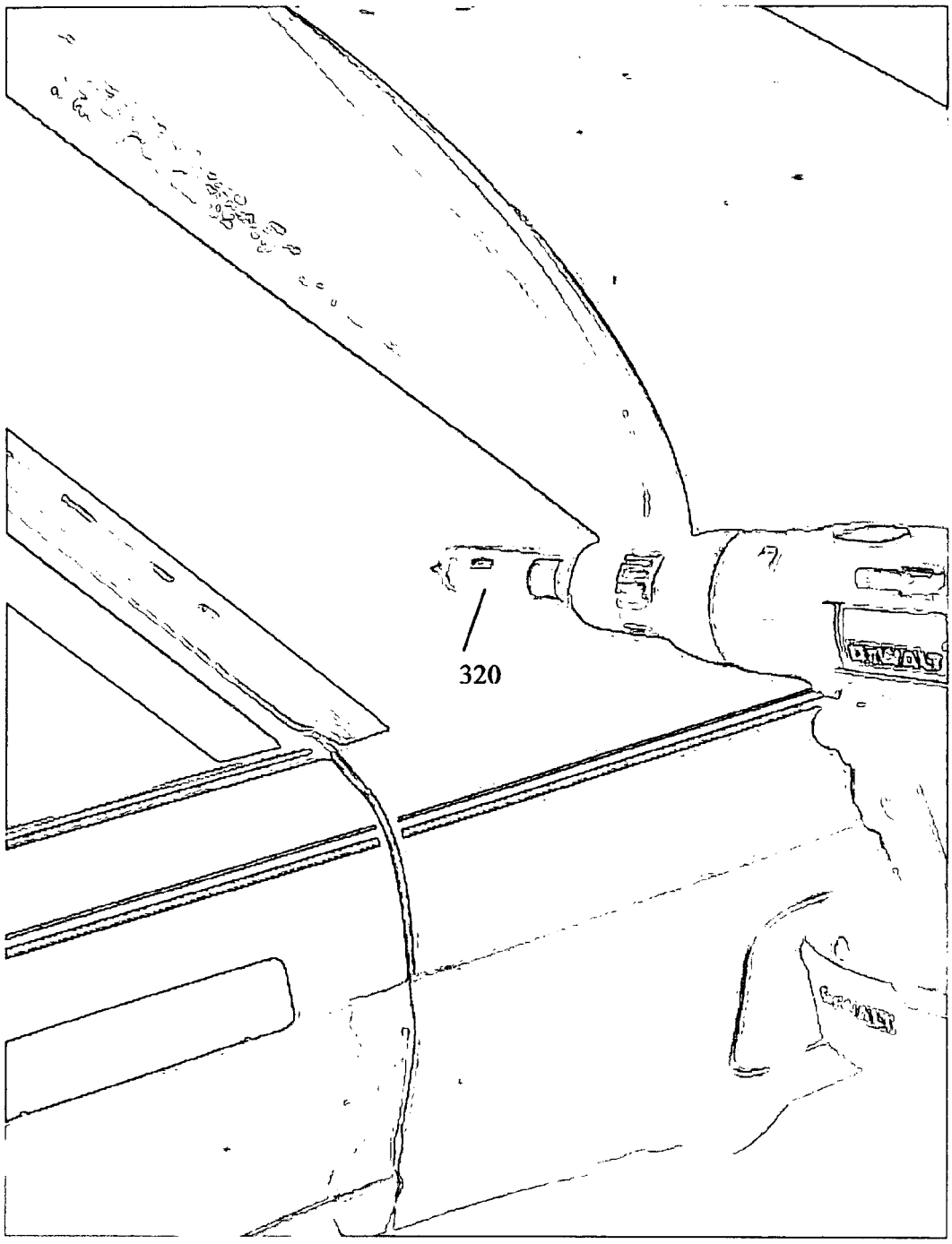
FIGS. 23*a*-23*c* show an alternative embodiment according to the invention, including the step of using a hole saw for creating a purchase point.
Figure 23B:
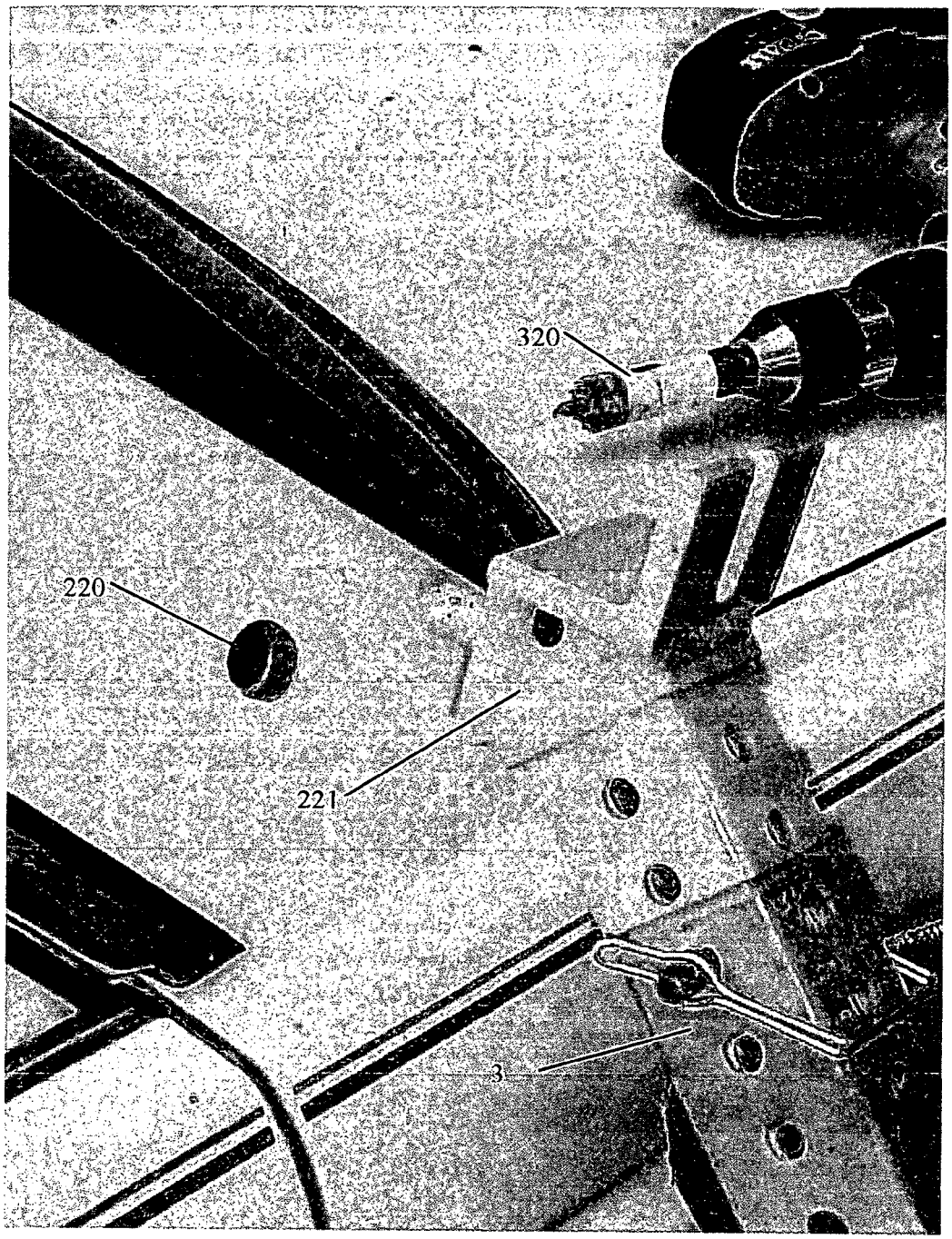
Figure 23C:
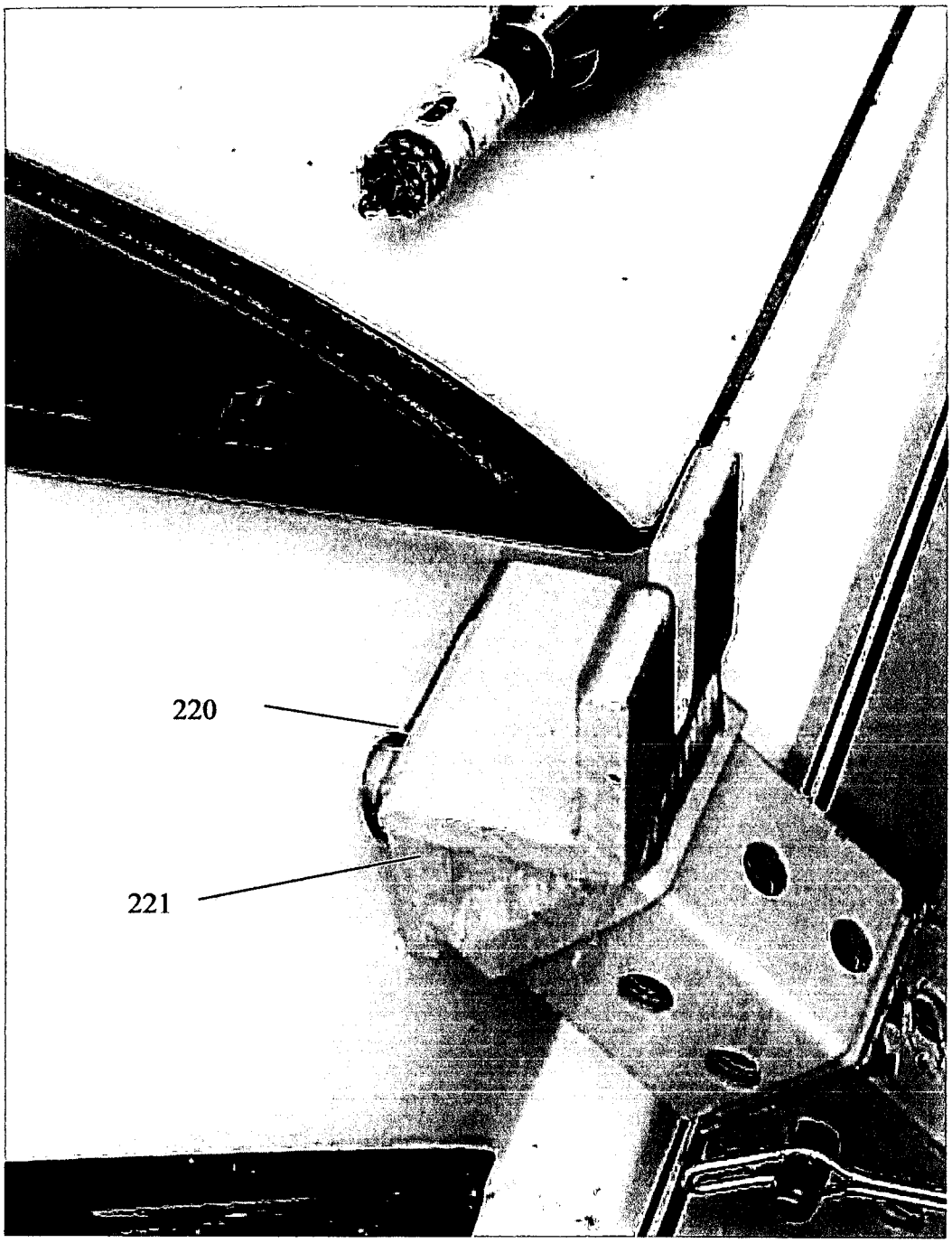

Referring now to FIGS. 23*a*-23*c*, a new method for creating a purchase point where needed in a non-violent fashion and without tearing involves the use of a drill operated hole saw. The hole saw quickly creates a smooth purchase point for a round point end fitting. The method includes the steps of creating purchase holes (220) using a drill-operated hole saw (320) in the desired location. A buttress stand (3) with a round point end fitting (221) is then leaned against the vehicle, with the round point inserted into the hole created by the hole saw. The base of the buttress stand is then attached to the vehicle or alternatively to the opposite buttress stand.

Figure 24A:
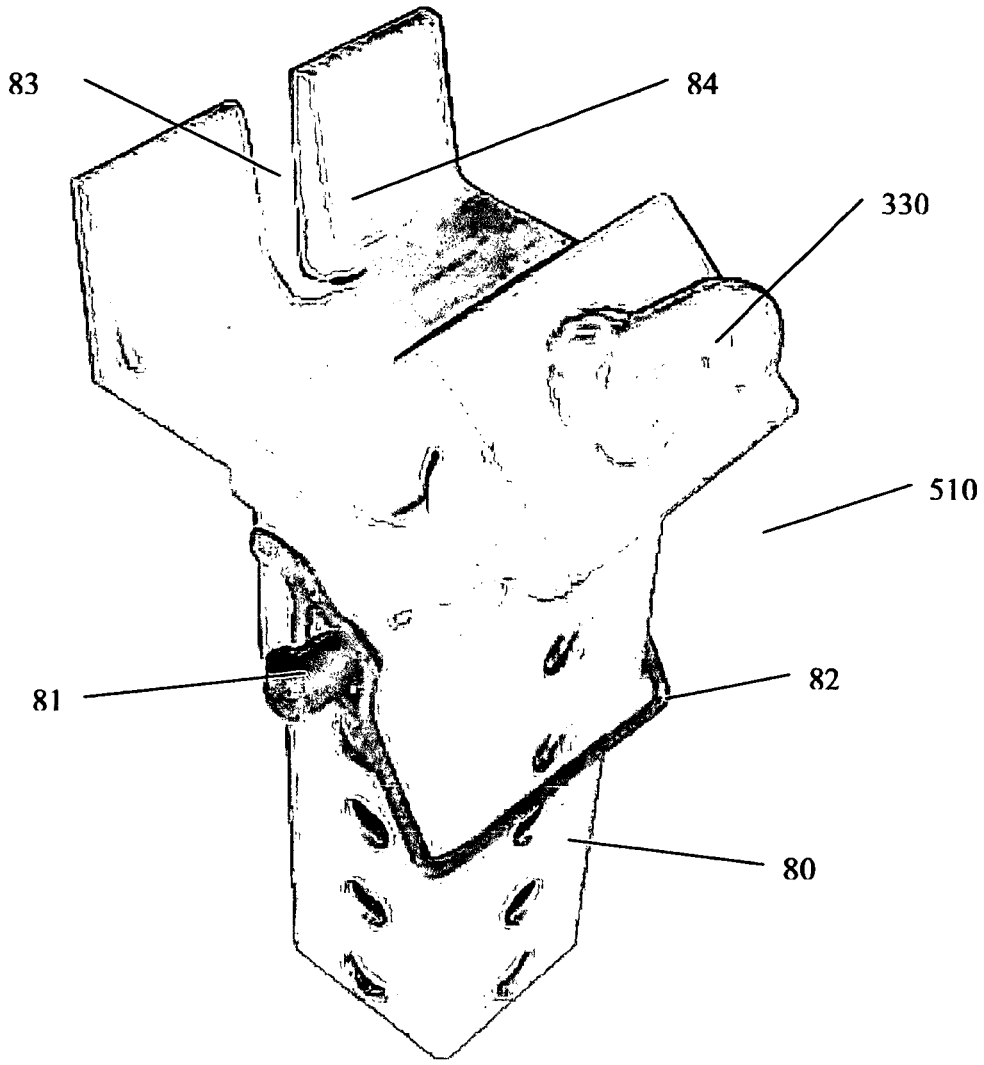
FIG. 24*a* shows a multi-use buttress stand end fitting, according to an embodiment of the invention.
Figure 24B:
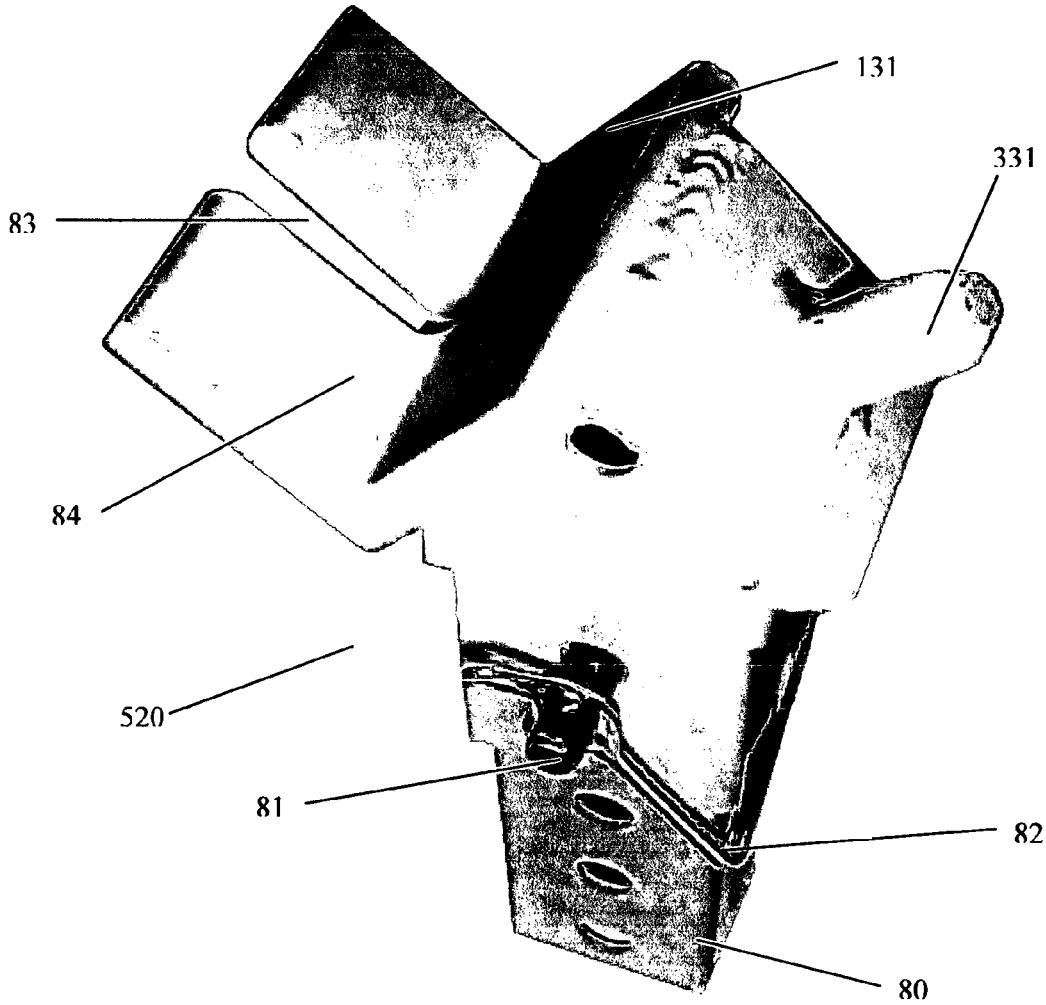
FIG. 24*b* shows a second multi-use buttress stand end fitting, according to an alternative embodiment of the invention.

FIGS. 24*a* and 24*b* show alternative embodiments of two new multi-use buttress stand end fittings (510, 520) incorporating multiple components to maximize versatility. It is desirable to maximize the number of characteristics within a single fitting to avoid the necessity of switching components. The end fitting (510) preferably incorporates a round point (222) for engaging holes, an angle bracket (223) for cradling corners or objects, a protruding lip (224) to engage a recess, and a slot (225) to grip a chain. Optional features include being rotatable, having a lock pin for chain engagement, and means for use with extendible stands or fixed length stands, such as timbers.

Figure 25A:
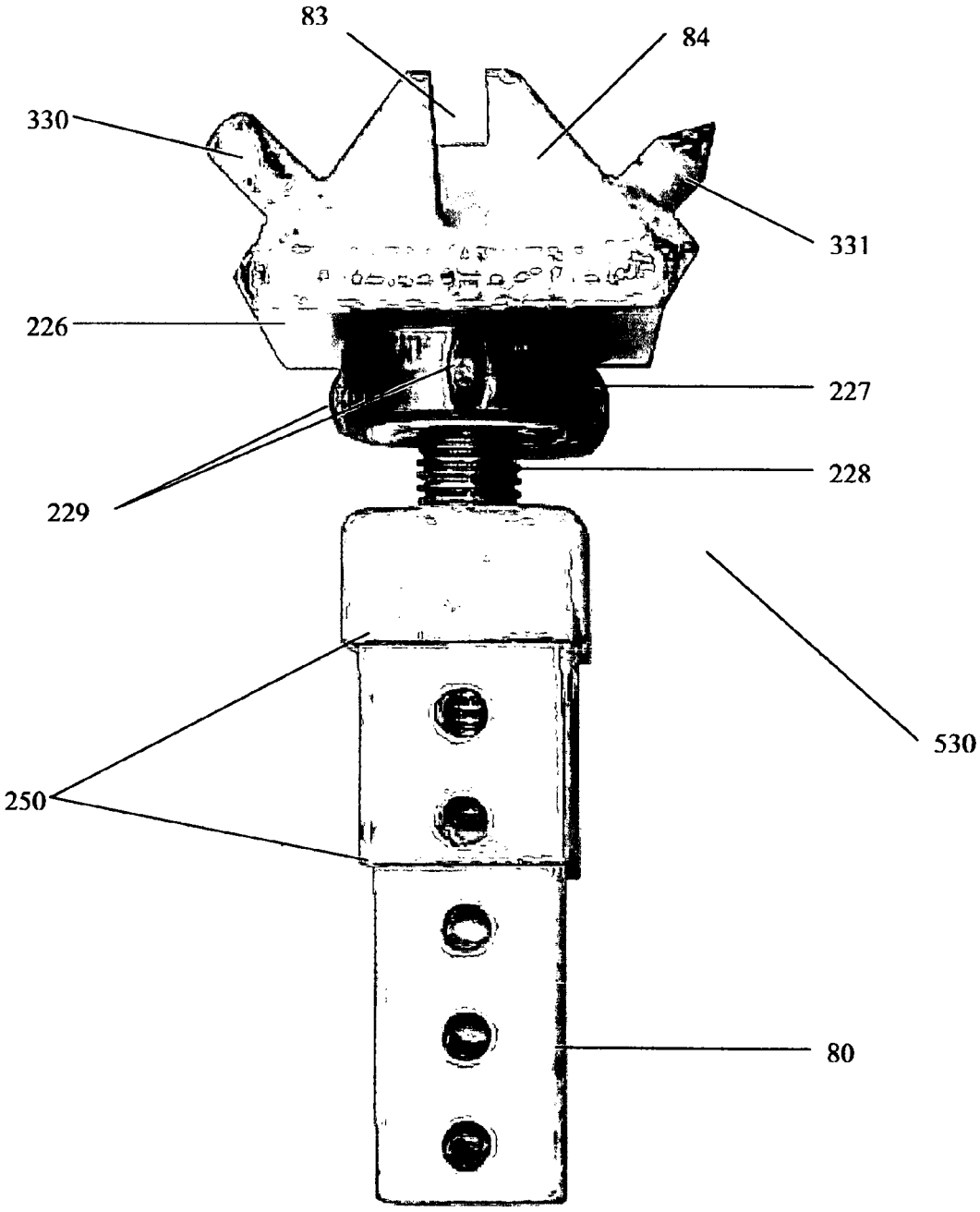
FIGS. 25*a* and 25*b* show two views of a turret head buttress stand end fitting, according to an embodiment of the invention.
Figure 25B:
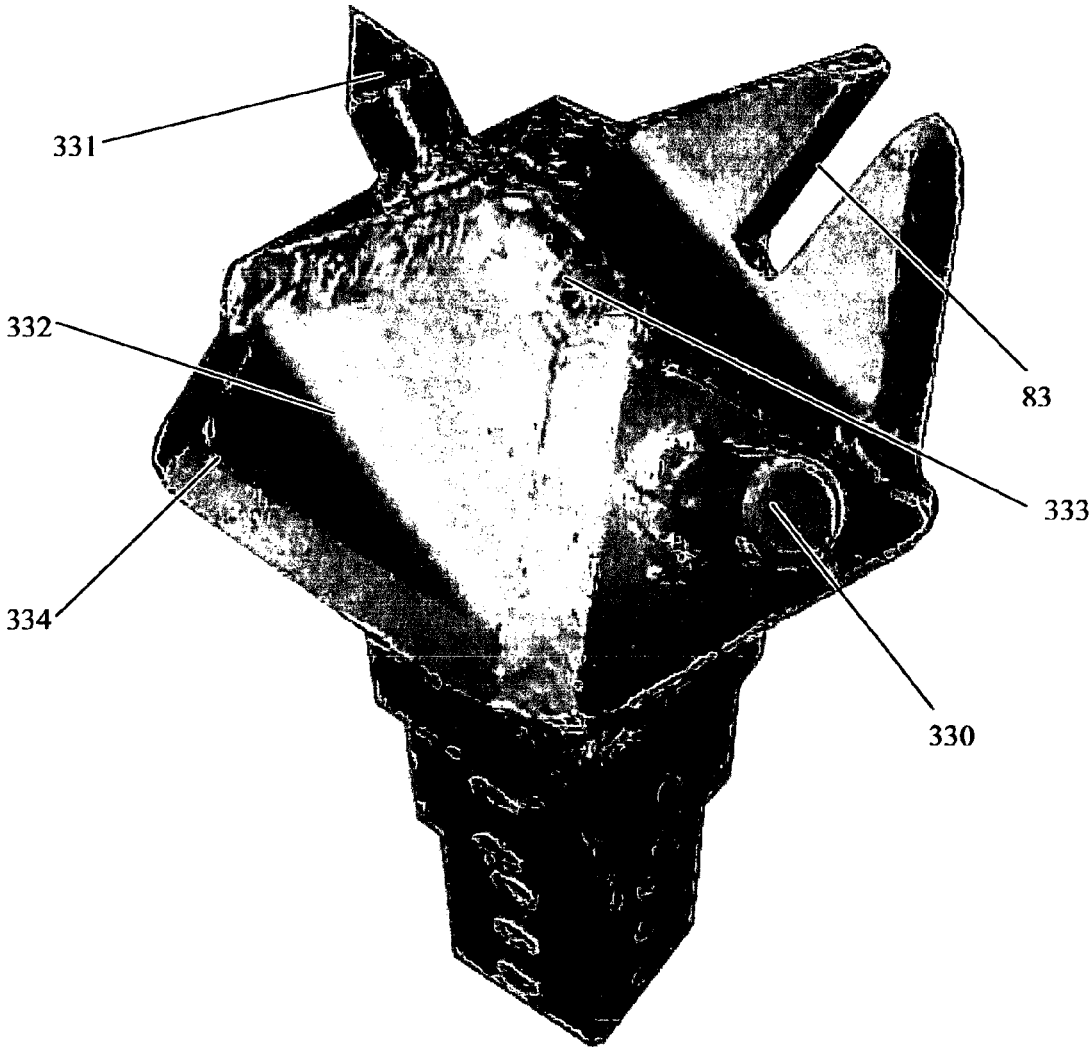

FIGS. 25*a* and 25*b* show a new turret head buttress stand end fitting (530). The head (226) raises and lowers by turning the ribbed collar (227) fixed to the threaded jack shaft (228). It has a ribbed or similar means (229) for gripping for use with a spanner wrench or similar means. The top of the head is free to rotate independently of rotation of the jack shaft. The base of the head preferably has a stepped design (250) to allow for insertion in multiple size components. It also optionally includes one or more engagement means, such as a chain slot (83) for chain engagement with or without a locking means, a blunt round pin (330) for engaging holes, a pointed round pin (331) for piercing holes, an angle (332) for cradling corners, a lip (333) for engaging a linear protrusion or a pointed flat protrusion (334) for additional piercing applications. It is designed to work with different stand types and/or wood timbers.

Figure 26:
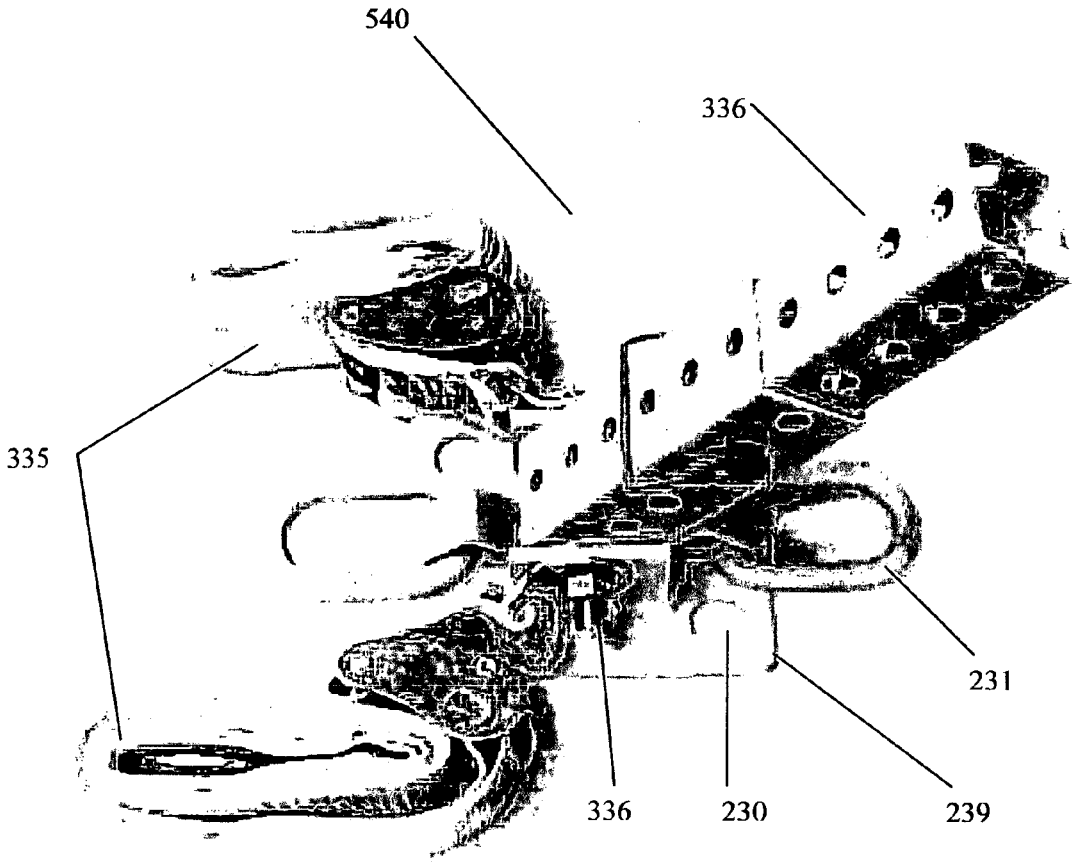
FIG. 26 shows a pivotal buttress stabilization base fitting, according to an embodiment of the invention.

Referring now to FIG. 26, a pivotal buttress stabilization base plate (540) is shown, having multiple components/characteristics to maximize versatility. It is desirable to maximize the number of characteristics within the base plate to accommodate multiple restraint types. The base (239) preferably incorporates round holes (230) for engaging stakes, pre-attached cam buckle straps, ratchet straps, chain, or other flexible members (335), and an attached link (231) for connecting straps, chains, cables, hooks, or similar restraining flexible members. The link optionally accommodates a large stake. Other optional features include pivoting means (336), having an upright post (337) and an anti-skid bottom surface.

Undercarriage Reinforcement of Roof-Resting or Side-Resting Vehicle

Figure 27:
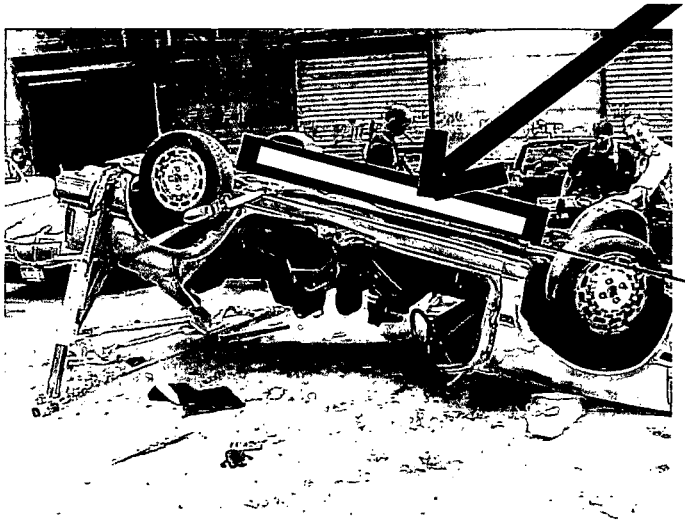
FIGS. 27*a* and 27*b* show an alternative embodiment according to the invention, including the step of adding undercarriage support to the vehicle.
Figure 27:
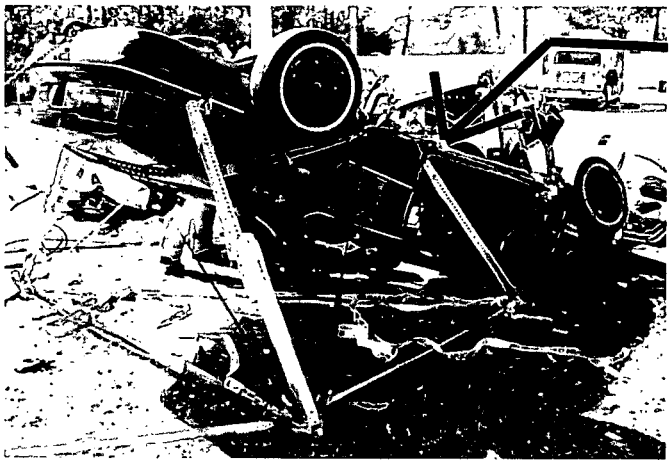

Referring now to FIGS. 27*a* and 27*b*, an alternative embodiment according to the invention is shown, including the step of adding undercarriage support to the vehicle. A preferred method includes supporting the vehicle floor pan structure, for example, during and following roof and door removal. This method also eliminates the need to place supporting components within the typical patient access and removal path. The method generally involves placing one or more beam-like structures (1000) at the floor pan or vehicle undercarriage (7). This beam is then aligned substantially parallel with the length of the vehicle. The beam is secured to the vehicle (1) at one or more locations, by means such as, for example, hooks, straps, chains, or any suitable securing means, in such a fashion as to reinforce the weakened vehicle undercarriage to prevent collapse.

The undercarriage reinforcement technique can be applied to a vehicle resting on its roof, its side, or an upright or otherwise positioned vehicle. For example, a vehicle may be significantly damaged due to the accident itself, wherein the undercarriage reinforcement technique can be beneficial to prevent further vehicle damage or undesirable movement.

The beam structure optionally is constructed from wood, metal, plastic, or a combination thereof. Suitable components typically available to a rescue team typically include wooden boards or beams (e.g., 4×4), aluminum ladders, logs, stabilization stands, or any rigid structure of sufficient length to reinforce a weakened area.

Buttress Stabilization Stands with Integrated Lighting

A preferred method of providing light according to the present invention involves integrating a light source electrically, chemically, or otherwise produced, with the shoring stand or buttress stabilization stand (3), preferably such that light is provided at or near one or both ends, and/or providing lighting at the stand sides or periphery, thus providing light to the work area. This is accomplished in one embodiment, for example, by means of affixing any standard light source to the outside of the buttress stabilization stand (3). A preferred means, which protects the light source from damage, includes embedding the light source within the stabilization stand, or stand components, handles or accessories. For example, the light source optionally is embedded within the stand base (or lower end), extension tubing, or the end fitting (or upper end).

The light preferably is diffusible and adjustable, such that it can be directed upward, downward, outward, or in all or any combination of directions. Optional diffusing means include, for example, mirrors, crystals, prisms, and any other glass or plastic object. Suitable light sources include any light source, and/or any type of light duct, such as a fiber optic cable, or an array of LEDs, which can be enclosed in a clear, watertight enclosure. Preferably, a switch means is operatively connected to the light source to allow a user to manipulate the light source on and off. In one embodiment, for example, the switch is accessible through a hole in the buttress stand, extension, base or end fitting, such that the switch is housed internally and thus protected from the harsh environment of rescue scenes.

Stabilization stand tubing often is constructed with perforations provided for allowing length adjustment. In an embodiment wherein the light source is located within the tubing, these holes serve as a means of emitting the light around the sides of the stand. The end fittings and/or bases optionally also have holes around the sides, as well as the end, for emitting light in an outward and/or endward direction. In an alternative embodiment, the light source is housed in or on the base (bottom), extension tubing (mid-section), or end fitting (top). This lighting serves the purposes of a work light as well as a tool location light, allowing users to find the tool in the dark, when not in use. Optionally, the stabilization stand includes multiple light sources at singular or multiple locations along its length.

Figure 28:
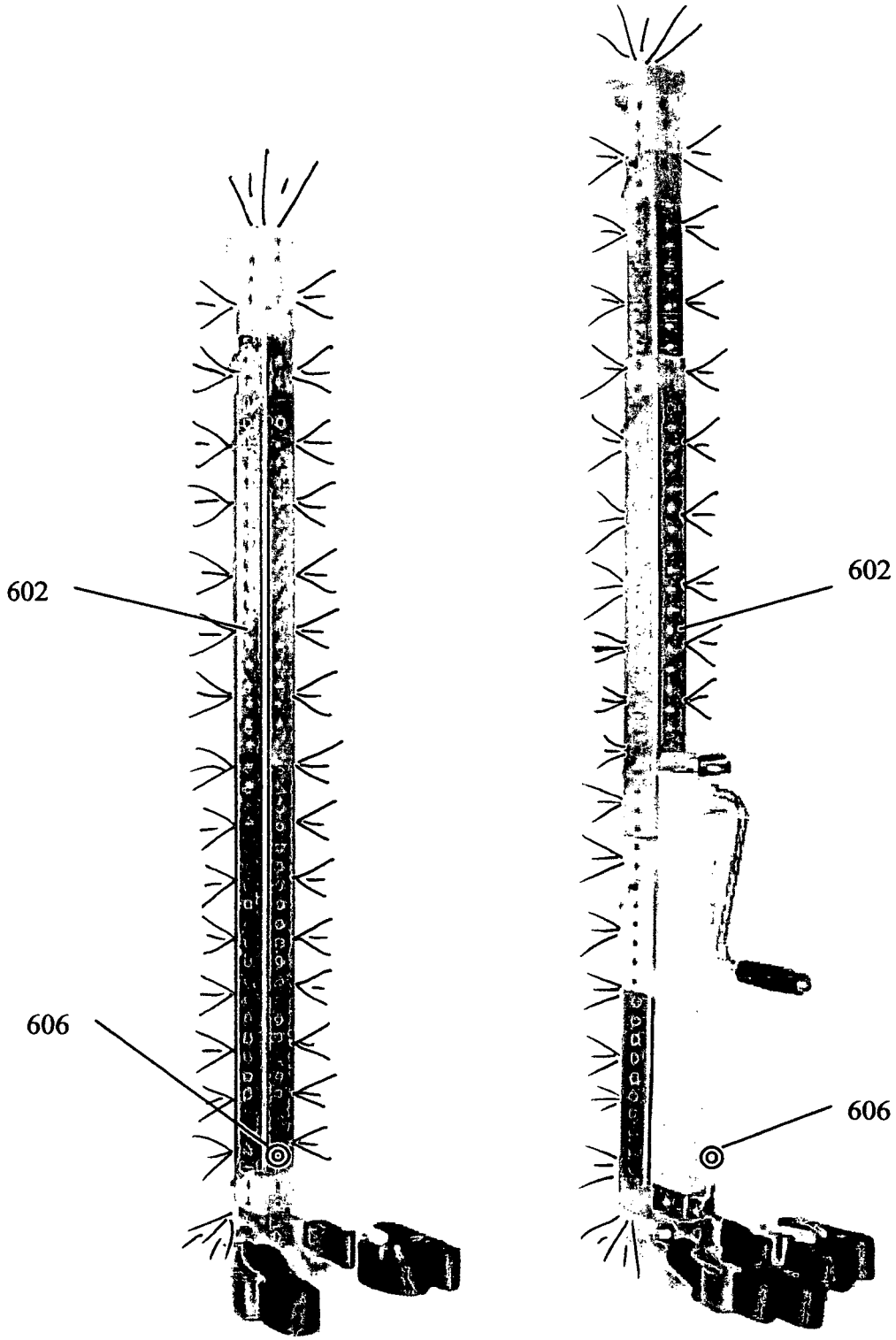
FIG. 28 shows two alternative embodiments of a lighted buttress stabilization stand, according to the invention.

Referring now to FIG. 28, an embodiment according to the invention is shown, including a buttress stabilization stand (3) comprising perforated tubing with an integrated light source (602) and an operatively connected switch means (606). The perforations provide light emitting means (604) along the length of the stand.

Another embodiment includes a protective housing attached to the outside of a stand, which contains a light source or multiple light sources that emit light in one or more directions. The protective housing optionally serves as or is affixed to a carrying handle for the stand.

A preferred means for delivering light is via a fiber optic cable running in around or on the outside of the stabilization stand to the various desired points of delivery. In an alternative embodiment, the light source comprises an array of LEDs, optionally including a battery power source and any required resistors. In another embodiment, the LED array is embedded in or covered by a substantially transparent or translucent medium, such as hard plastic or glass, for example (e.g., polycarbonate).

A diffusing means optionally is incorporated to spread light in the desired directions. For example if a light source is located at the base of a stand directed toward the end fitting at the opposite end of the stand and peripheral light is desired at the end fitting, a means for redirecting or partitioning the light is provided at or near the end fitting to provide peripheral light, in addition to providing axially directed light.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of stabilizing a vehicle in an unstable position, comprising the steps of:

a) leaning a first buttress stand and a second buttress stand against a right fender area and a left fender area at an end of said vehicle, each buttress stand having a base, an end fitting, and a length therebetween, the buttress stands being arranged with the end fitting nearest the vehicle and the base on the ground, spaced outwardly from the vehicle;

b) restraining the buttress stand bases from sliding;

c) securing the vehicle using a technique selected from the group consisting of i) wrapping a flexible tie member around at least one rear post of the vehicle;

ii) entering through a rear window opening of an inverted vehicle and attaching a J-hook to at least one rear post of the vehicle, the J-hook having a flexible tie member attached thereto;

iii) entering through a side window opening of an inverted vehicle and attaching a J-hook to at least one sidewall of the vehicle, the J-hook having a flexible tie member attached thereto; and iv) entering through a rear window opening of an inverted vehicle and attaching a J-hook to a rear deck or speaker deck of the vehicle, the J-hook having a flexible tie member attached thereto;

d) passing an opposite end of the flexible tie member up or across the side of the vehicle, where it is engaged with the fitting affixed to the buttress stand;

e) placing one or more beam structures at the floor pan or undercarriage of the vehicle;

f) aligning said beam structure substantially parallel with the length of the vehicle; and g) securing said beam structure to the vehicle at one or more points, h) further comprising the steps of providing at least one light source within the buttress stabilization or shoring stand, and illuminating a work area near or around the vehicle using said light source.

2. The method of claim 1, wherein said buttress stabilization or shoring stand comprises switch means for manipulating said light source, means for redirecting, partitioning or diffusing said light, and a protective housing or cover for protecting said switch means and said means for redirecting, partitioning or diffusing said light.

3. The method of claim 1, wherein said buttress stabilization or shoring stand comprises a tubular member having one or more perforations for emitting light from said light source located within the buttress stabilization or shoring stand.

4. The method of claim 1, wherein said light source comprises an LED array, fiber optic cable or other light duct.

5. The method of claim 1, further comprising switch means for manipulating said light source.

6. The method of claim 5, wherein said switch means is protected by a protective housing or cover.

7. The method of claim 1, further comprising means for redirecting, partitioning or diffusing said light.

8. The method of claim 7, wherein said means for redirecting, partitioning or diffusing said light is protected by a protective housing or cover.

9. The method of claim 7, wherein said means for redirecting, partitioning or diffusing said light is selected from the group consisting of a mirror, a crystal, a prism, any other glass object, and any other plastic object.

10. The method of claim 1, wherein said light source is embedded within or affixed to an exterior structure of said buttress stabilization or shoring stand.

11. The method of claim 10, further comprising a protective housing or cover for protecting said light source embedded within or affixed to said exterior structure of said buttress stabilization or shoring stand.

* * * * *